US005839968A

United States Patent [19]

Latella

[11] Patent Number: 5,839,968

[45] Date of Patent: Nov. 24, 1998

[54] CLUB SWING TRAINING METHOD AND APPARATUS THEREFOR

[75] Inventor: Frank A. Latella, Wilton, Conn.

[73] Assignee: TheraGolf, Ltd., White Plains, N.Y.

[21] Appl. No.: 585,094

[22] Filed: Jan. 16, 1996

[51] Int. Cl.[6] ..... A63B 69/36

[52] U.S. Cl. ..... 473/219; 473/409; 473/215; 473/218; 473/276; 473/277; 473/256; 473/596; 273/DIG. 20; 482/91

[58] Field of Search ..... 473/207, 215, 473/217, 270, 271, 277, 409, 212, 266, 273, 276, 218, 256, 596; 273/DIG. 20; 482/91

[56] References Cited

U.S. PATENT DOCUMENTS

| | | | |
|---|---|---|---|
| 3,774,572 | 11/1973 | Borraccio | 473/207 X |
| 4,045,033 | 8/1977 | Schuman | 473/266 |
| 5,149,099 | 9/1992 | Radakovich . | |
| 5,174,575 | 12/1992 | Leith et al. . | |
| 5,203,567 | 4/1993 | Erlinger et al. | 473/276 |
| 5,295,690 | 3/1994 | Johnson . | |
| 5,301,948 | 4/1994 | Hundley . | |
| 5,303,927 | 4/1994 | Perry et al. . | |
| 5,308,074 | 5/1994 | Dorotinsky et al. . | |
| 5,362,059 | 11/1994 | Grossman . | |
| 5,501,464 | 3/1996 | Dalbo | 473/215 X |
| 5,735,776 | 4/1998 | Swezey et al. | 473/596 X |

OTHER PUBLICATIONS

Maddalozzo, G.F. John, An anatomical and biomechanical analysis of the full golf swing, 1987 pp. 6–8 and pp. 77–79, *NSCA Journal* vol. 9 No. 4.

Egosque, P. and Gippines, R., The Egosque Method, pp. 1–22, Harper Collins 1992.

Page et al., Posterior Rotator Cuff Strengthening Using Theraband in a Functional Diagonal Pattern in Collegiate Baseball Pitchers.

"An Ounce of Prevention . . . " by Mary Biggar, *Golf Magazine*, Jun., 1995, pp. 148–149.

"Getting into the Groove . . . " by Don Hurter and Susan Sanders, *The Golfer*, 1995, pp. 54–58.

"A Perfect Golf Swing Can Cause Real Pain", *The New York Times*, Jun. 1, 1995.

*Primary Examiner*—George J. Marlo

*Attorney, Agent, or Firm*—Handal & Morofsky

[57] ABSTRACT

A method for swing training particularly suitable to golf and sports employing a similar power swing is disclosed wherein preferably pliable body spacer objects such as balls of varying sizes, weights, and pliability are placed between a limb and another body surface to restrict movement of said limb wherein specific muscles groups are stretched and trained while imitating swing motion to induce muscle memory. A lightweight ball of at least 25 cm. diameter is placed between the thighs and a smaller ball, e.g. a medicine ball of about 10–25 cm. diameter is gripped between the elbows. Also a ball or other object may be gripped under an armpit.

36 Claims, 11 Drawing Sheets

BEGINNER DRILL 1

BEGINNER DRILL 2

BEGINNER DRILL 3

BEGINNER DRILL 4

INTERMEDIATE DRILL 1b

INTERMEDIATE DRILL 2b

INTERMEDIATE DRILL 3b

INTERMEDIATE DRILL 4b

ADVANCED DRILL 5
ADVANCED DRILL 6–7
INTERMEDIATE DRILL 1c–4c

ADVANCED DRILL 5b

ADVANCED DRILL 5b

ADVANCED DRILL 8b

ADVANCED DRILL 9

ADVANCED DRILL 10

ADVANCED DRILL 11

ADVANCED DRILL 9b
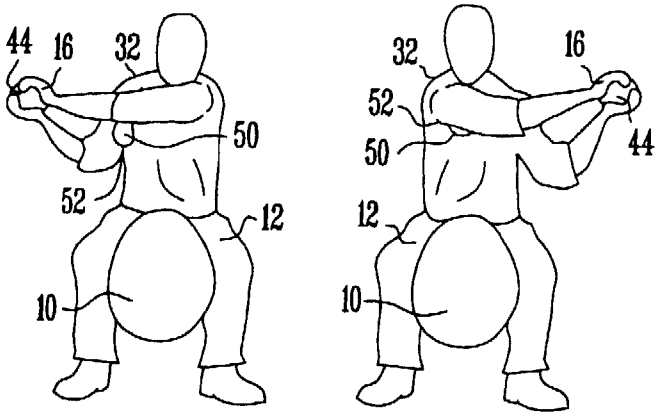
FIG. 60
FIG. 61
ADVANCED DRILL 10b
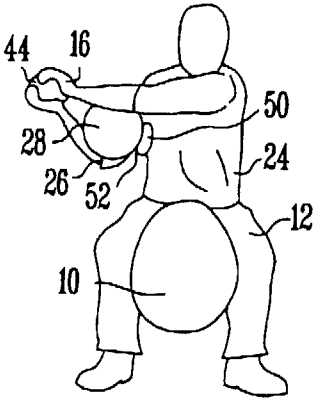
FIG. 62
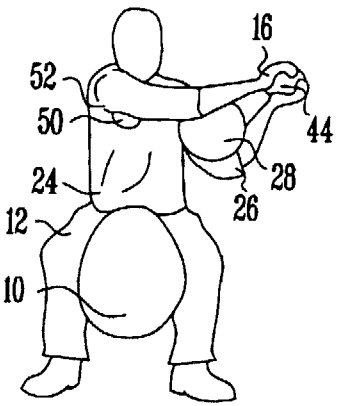
FIG. 63
ADVANCED DRILL 11b
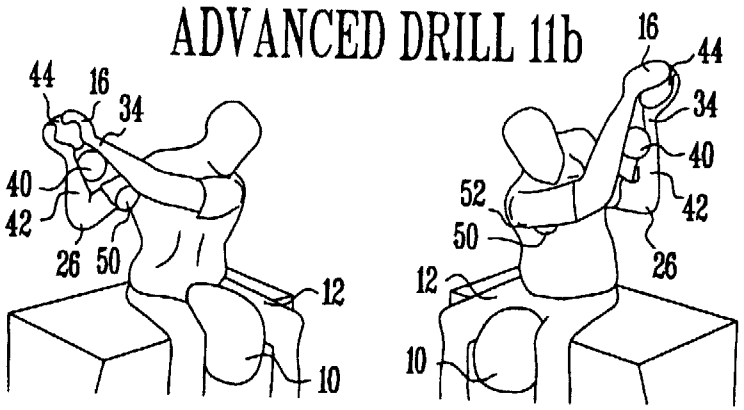
FIG. 64
FIG. 65
ADVANCED DRILL 9c–11c
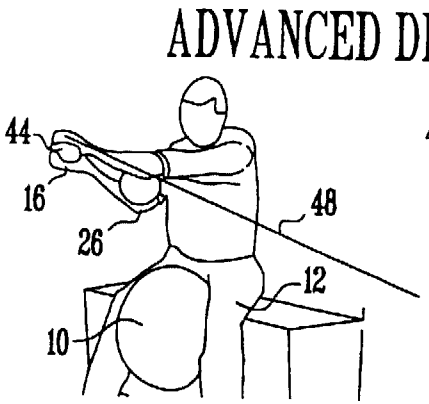
FIG. 66
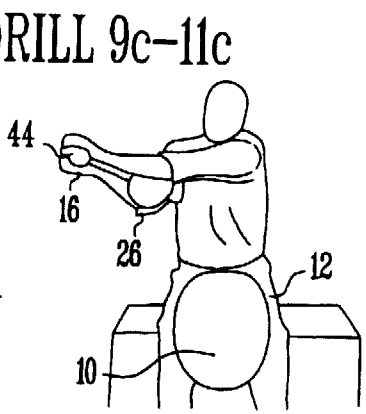
FIG. 67

ROTATIONAL DRILL A
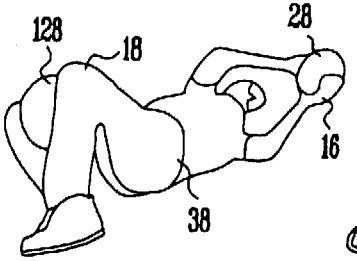
FIG. 68
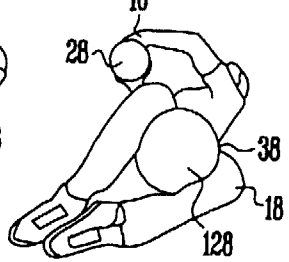
FIG. 69
ROTATIONAL DRILL B
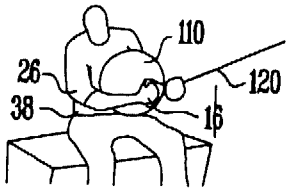
FIG. 70
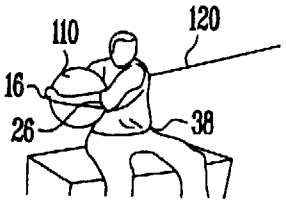
FIG. 71
ROTATIONAL DRILL C
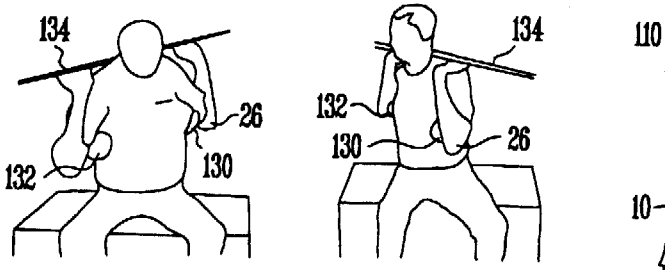
FIG. 72
FIG. 73
ROTATIONAL DRILL D
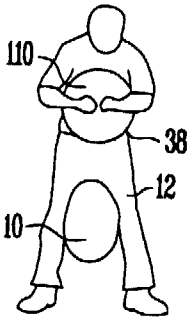
FIG. 74
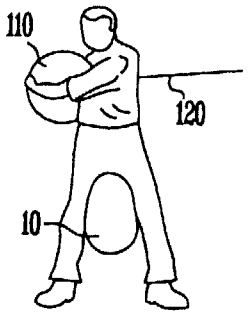
FIG. 75
ROTATIONAL DRILL E
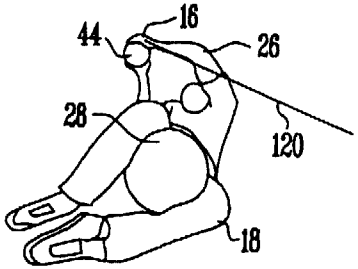
FIG. 76

CLUB SWING TRAINING METHOD AND APPARATUS THEREFOR

TECHNICAL FIELD

The present invention relates to a method for swing training. The method is both a training method to improve sport specific muscle memory while stretch training the same muscles to be in desired physical condition for the execution of the swing. A number of popular sports including golf, tennis, baseball, and hockey require the arms to swing while holding an elongated striking implement, for example a club, bat, or racquet, for the purpose of hitting an object. Fishing employs a comparable action to cast a lure into the water.

BACKGROUND

Although many swing training methods and devices are known in the prior art, no known method or device is fully effective in improving athletic performance and preventing muscle dysfunctionality.

Muscle injuries are common to athletes as result of repetitive and unusual strain on various muscle groups. This problem is often more pronounced in sports such as golf, baseball, and tennis where a good swing is an essential component of the sport. A poor swing training technique leads, athletes to inconsistencies in their game, and may lead to injuries as well as too poor execution of the athletic task. Prior attempts to overcome these problems have included various stretching exercises as well as squats and crunches to strengthen and tone muscles. Although these exercises help to increase muscle flexibility, these methods have not provided all the improvements golfers seek from training methods.

In golf, existing methods often overcomplicate the functions of the swing plane and preferred club positioning, while underestimating the importance of proper setup and how it affects swing mechanics. Golfers who have tried to improve their swings have often given up, commenting that their feel is compromised by the distraction of bearing in mind the many technical points needed to make the adjustments required to correct the faults in their swing.

Physiology

To better understand the problems of providing an effective swing training method, it is helpful to understand the physiology involved with the movement of the body when executing a swing. The bones and joints form a system of levers in the human body with the muscular system providing force and movement to the levers. There are two types of joints: hinged joints that flex and extend the limb; and ball and socket joints that rotate the limb in one direction or another. Every joint is moved by at least two opposing sets of muscles.

It is clear that if both opposing muscle sets contract together equally there will be no movement of the joint. Conversely, the greatest amount of power will be generated when one set contracts and the opposing set of is in a state of complete relaxation. Put another way, the force of a concentric contraction of a muscle can be enhanced if it is immediately preceded by an eccentric contraction by the same muscle. A concentric contraction has a line of action passing through the center of the joint, and therefore does not urge rotation, while an eccentric contraction is off-center and urges the joint to rotate. A complete state of relaxation cannot be reached if the muscles are not flexible. Therefore, during the execution of any movement, the person should not tighten the muscles. Also, a person can be genetically predisposed to muscle tightness.

Energy may be stored in a muscle in the form of elastic energy. When a contracting muscle is forced to stretch, some of the work done in stretching the muscles is available in the following contraction. Maximum reuse of stored energy will follow if the contraction immediately follows the stretching. This type of contraction yields more power, more speed and more efficiency.

Undesired muscle tensions also increase as the body tries to restore lost balance or make other compensators for errors, so that reducing mistakes made in the initial setup and early in a swing will keep the player relaxed and swinging freely.

Therefore there is a need to stretch and selectively train groups of muscles to prevent dysfunctionality and improve overall performance in athletic activities requiring a swinging skill.

Previous Attempts to Train Specific Groups of Muscles

There have been previous attempts to train muscle groups selectively to prevent dysfunctionality and to improve overall performance in athletic activities.

THERABAND™ elastic band, an elastic band attached to a wall was developed to provide specific eccentric training intended to enhance muscular recovery following pitching in baseball or softball, thus reducing muscle soreness. Isotonic exercises are performed with the elastic band which is used to add resistance to increase the work of isolated muscles to strengthen them.

Because of the limitations of the THERABAND™ elastic band mechanics, it appears that the subjects were not able adequately to duplicate the actual motion of a baseball swing. Thus, the apparatus and related method do not develop muscle memory needed for adequate swing training. Rather this device is limited in it use for stretch training to develop muscles for general use.

The Ecosque Method attempts to correct dysfunctional muscle control through a series of several exercises designed to strengthen muscles used in athletic activities including golf. One drawback of the Ecosque method is that it is not adequately specific for golf. Diagnostic testing is used to try to pinpoint specific problem areas, where muscle flexibility is limited. The method provides stretching exercises using a T-bar, and some weight training. The method does not appear to help a golfer or other athlete maintain a proper swing plane and improve the mechanics of a sports swing.

Neither method seems to tailor the exercises specifically to the needs of golfers. Furthermore, the methods do not appear to obtain any benefits from muscle memory training. Therefore, there is a need for a method of swing training designed to meet, inter alia, the specific needs of golf, where the player or trainee can strive for the execution and maintenance of an ideal or desired swing plane.

Various loops, tethers, cuffs, harnesses and the like have been proposed for training golfers by physically constraining one or more body movements. These devices may be awkward to use or inconvenient to attach and, while each presumably supplies some benefit, none satisfactorily trains a golfer to have a precise and powerful swing employing simple training aids.

For example, Radakovich, in U.S. Pat. No. 5,149,909, discloses a golf club swing training device and method employing an elastic loop worn around the neck, chest and hips which is intended to correct tie user's golf swing. The elastic loop is donned over the head of the player with the major portion of the loop resting over the chest, abdomen and shoulders. The player swings against an upward pull exerted by tension in the elastic loop to produce improved control of the golfer's arms. Radakovich's device does not appear adequate to meet the specific need for training, stretching, or preparing muscles for a precisely executed golf swing. For example, Radakovich's training device and method does not prevent a flying right elbow, arms separating or casting of the club. Nor does Radakovich's device train the user to properly position the hips, legs, knees and feet. The method does not necessarily increase shoulder turn, cause any separation turn and trunk rotation, and does nothing to train the lower body, which are desirable training requirements. Radakovich's method emphasizes left hand and left arm movements for right handed players. Furthermore, Radakovich's method does not correct arm position at the top of the backswing, correct posture, correct weight disbursement, or help coordination and stability throughout swing plane in a manner achievable by means of the present invention. Nor does Radakovich's method address physical limitations of individual golfers, for example if a person lacks the flexibility to turn the shoulders and hips, separately.

Leith, U.S. Pat. No. 5,174,575, discloses a harness to be worn by a golfer while making practice swings which harness restricts the golfer's arm and hand movements. Leith's device may provide some control of the hands and arms in relation to the club, but it appears to do little or nothing to control and train other components of the golfer's body that are important to the swing.

According to Leith's disclosure, a flexible strap or a rigid rod is attached to a point on the shaft of the golf club, just above the club head, and extends to a point on the golfer's forearm where it is adjustably fastened. The position on the arm is adjustable. The device appears to be intended to support the arms to keep them straight just before impact, and does not appear to constrain other body components. The lack of restriction of movement in other areas of the body appears to prevent effective muscle memory training. Nor does Leith address the issue of muscle stretch training in significant areas of the body such as the hip, arm, shoulder and leg areas. Furthermore, Leith's harness does not help increase the range of motion or the flexibility of the shoulders, hips, and trunk. Nor does it prevent many common faults such as flying right elbows, twisting and bending of the knees, and twisting of the legs. Nor does the device address a player's physical limitations or lack of conditioning. Leith's methods do not provide adequate training for golfers desiring a significantly improved swing.

Johnson, U.S. Pat. No. 5,295,690, appears to control and perhaps train somewhat more of the golfer's body than does Leith but does little or nothing to train other body components important to the swing, for example the legs.

Johnson discloses a golf swing device including two elastic arm cuffs which are interconnected, and which each fit on one of the golfer's arms such that the golfer's arms are biased towards each other while executing a golf swing. An elastic hip strap is connected to the arm cuff holding the trailing swing arm and includes a clamp which is secured to a point in proximity to the golfer's hip which is on the opposite side of the golfer's body from the golfer's trailing swing arm. Johnson's device appears to restrict arm movement, possibly relative arm and hip movement and, to a degree, wrist movement and to keep the elbows together throughout the swing, which may or may not be effective in preventing a flying right elbow, but does not appear to train the lower body. Furthermore, some of the restrictions imposed by Johnson's rather complex restraining device may even hinder desirable results such as muscle memory training.

Hundley, U.S. Pat. No. 5,301,948 disclose s a complex free-standing apparatus for golf swing training which controls the movement of the head of a club to force the golfer to maintain one swing plane. Reportedly, the Hundley device allows the user to imitate the hand movement used in a proper golf swing, as well as allowing for the full extension of the golfer's arms in follow-through. This device comprises a system of articulated arms including a swing element, a swing plane adjuster element, and an upright post-and-base element to support the movable elements from the floor. The device also uses an adjustable counterbalance connected to vary the loading with a view to developing muscles required in golfing. The biomechanics of the swing lack muscle group specificity and lower body training is not effectively addressed. In addition, because of the strong physical restraints imposed on a golfer's limbs, without supervised use, the device may actually lead to muscular dysfunction or minor injury with inappropriate muscle movements and weight distribution to the back and legs.

Perry et al, U.S. Pat. No. 5,303,927, discloses a golf training device including a hip belt and an elastic cord where one end of the elastic cord is attached to the belt and the opposite end is attached to a stirrup for receiving a foot of the golf player and method using the same. The stretched cord is designed to create a rotational torque at the hips of the player to assists the player in maintaining a good body stance and properly turning the hips as required for a good swing. Perry's device is designed to induce the user to perform the proper turning of the hips during swing. The device seems to restrict hip movement by inducing good rotation while restricting arm movement. However, it is not clear from the disclosure if the arm is guaranteed to swing back in the exact plane desired to achieve maximum effect. Furthermore, there is no restriction of the legs and knees which may twist and turn or be spaced awkwardly apart. No time mechanics are addressed since the upper torso and limbs are totally unaffected. Finally, the Perry's cord may get in the way of good mechanical use of legs. The novice golfer using Perry's device would have difficulty with the proper placement of the feet, and the positioning of legs and hips.

Dorotinsky et al, U.S. Pat. No. 5,308,074, discloses a golf sting training device having an adjustable belt, intended to be worn around the waist, which belt is attached to one end of a resilient cord, the other end of which is attached to a stake which is affixed to a ground mass. The cord is designed to stretch during the user's backswing and retract during the user's follow-through and the device is intended to guide the golfer's hips and body. However, there is no upper body training, no control of upper torso, shoulders, hands and arms to keep appropriate positions throughout the swing. Nor does Dorotinsky's device address body stability, coordination and flexibility. In addition there are drawbacks to Dorotinsky's methodology so far as it relates to the hips. For example, Dorotinsky's device cannot guide the golfer through the entire sequence of hip rotation involved throughout the swing because it is inherently a one-sided training method which works only on hip rotation in the back swing (or possibly, only in the follow-through). Furthermore, since the device pulls the user, it does not allow them to work against resistance in the follow-through nor in the finish.

Grossman, U.S. Pat. No. 5,362,059, discloses a training device consisting of a flat rectangular framework around air resistant material, which framework is attached to a handle gripped by a swinger. Grossman's object is to provide a variable amount of air resistance to simulate muscle forces felt in an actual golf swing. The amount of drag is determined by the nature and extent of the material within the framework. A further stated object is to train swinger's muscles for good swing motion. However, Grossman does not seem to address the rotational movement of the hips in the backswing phase, nor does it ensure good positioning of the wrists. Nor does Grossman appear to provide any control of foot and leg position nor address the problems of a flying elbow, bending knees and other unnecessary movements. Furthermore, Grossman's device presumably will not build muscle since there is insufficient muscular overload to require any significant muscle memory not exactly trained.

Other than Grossman and the Ecosque exercises, the above-described swing training methods depend upon the use of a restraining device, physically to limit the free range of movement of some part of the golfer's body. Such devices offer some risk of jarring and perhaps injuring muscles or tendons if the imposed limit is reached suddenly. Such devices are designed to oppose and physically limit specific muscular activity responsible for undesired movements during the swing. Because a group of muscles is prevented by physical restraints from executing certain undersired movements while a swing is repeatedly practiced offers no guarantee that bad habits will not be resumed when the restraints are removed. It would be desirable to provide a swing training method where the body naturally constrains itself, by its own, unfettered muscular exertions to avoid undesired movements and which method preferably also enhances the ability of the body to perform desired movements.

Such a training method should be simple to practice and preferably employ simple, inexpensive and portable training aids or devices. It should preferably also be biomechanically specific to a desired or preferred swing pattern without unduly sacrificing the efficiency and intensity of the exercise of swinging the club

SUMMARY OF THE INVENTION

The invention, as claimed, is intended to provide a remedy. It solves the problem of how to functionally train golfers and other player or athletes, for execution of a good swing. The invention addresses the dual concerns of muscle flexibility and muscle memory training. In preferred embodiments, the invention provides a method of functional swing training wherein specific muscle groups are urged to work in a comparable manner to their desired use in a golf swing or in some other sport swing. Desired functions involve the body osseous system that provides support, the muscular systems that provide control, and the proprioceptive system that coordinates and directs movement, all of which are profoundly affected by gravity, ground reaction forces, and swing momentum.

A preferred series of exercises according to the invention uses balls of varying sizes, weights, and pliability gripped in strategic body locations to focus training on isolated specific muscle groups while increasing muscle movement and range of motion. The series of motions prescribed by the exercises mimic the movement of a swing. The added weight of a pliable ball increases resistance and the benefits of the isolated muscle group training.

Thus, the invention provides a method for swing training comprising gripping a supportable spacing object between a limb and another body component, holding another object between the hands and executing a swing motion while gripping the spacing object to support it.

Preferably, the other body component is another, similar limb, and preferably the limbs are the thighes, elbows, arms or knees. In one embodiment, the object is a large ball having a diameter between about 10 to 22 inches and a weight under one pound which is gripped between the thighs. In another embodiment, the supportable object is a medium ball with a diameter between about 4 to 10 inches and a weight between about 2 to 10 lb. and it is gripped between the arms. In a third embodiment, the object is a small ball with a diameter between about 2 to 8 inches and a weight between about 7 oz. and 8 lb. and it is gripped between the hands, or under the armpits, while a larger ball is gripped between the thighs.

Other embodiment of the invention employ combinations of these embodiments or multiple grippable objects supported in different locations between a limb and another body component, for example, a relatively large ball gripped between the thighs while a relatively medium-sized ball is gripped between the elbows or forearms, and a swinging exercise is perfomed gripping a club, simulated club, bat or ball between the hands.

When practiced according to the teachings herein, the swing training method of the invention can harmonize the diversity of needs of sports utilizing swinging and address both the need for muscle memory training and the parallel need to stretch specific muscle groups to respond to the training to ensure both improved performance in the swing and less muscle dysfunctionality. These desirable results are obtainable without any of the drawbacks, such as strains or minor injuries that may be associated with tethering the arms or legs or hands or feet, according to many of the prior art swing training methods. By gripping one or more balls or equivalent body spacer objects as described herein, a golfer or other user is easily guided to maintain certain desirable relative positions of body components throughout practice swings. The physical presence of the ball or balls prevents the knees or elbows or other body components from being brought too close together, while maintaining the body spacer objects in position between the thighs, elbows arms, hands or under an armpit, induces desirable voluntary muscular contractions and elongations. A major problem in training exercises is that of feedback: the golfer or golf trainee may have difficulty knowing whether or not they are performing the exercise correctly. Pursuant to the methods of the invention, this problem is largely overcome in that if the golfer fails to grip a ball properly, they will immediately know it because the ball will drop to the floor.

BRIEF DESCRIPTION OF THE DRAWINGS

Some embodiments of the invention will now be described in detail, by way of example, with reference to the accompanying drawings which illustrate several methods of swing training specific to golf:

FIG. 7 is a side view similar to FIG. 1 where the golfer is in the last of the seven positions of Drill 1, and is completing the follow-through;

FIG. 8 is a schematic front elevational view of a further embodiment of the invention showing a golfer practicing the method of the invention in the first of eight positions of a second drill suitable for beginners, Drill 2;

FIG. 9 is a side view similar to FIG. 8 where the golfer is in the second of the eight positions of Drill 2, and is executing a backswing, club partially advanced;

FIG. 10 is a view similar to FIG. 8 where the golfer is in the third of the eight positions of Drill 2, and continues executing a backswing with the club at the top of the backswing;

FIG. 11 is a view similar to FIG. 8 where the golfer is in the fourth of the eight positions of Drill 2, and is executing a downswing, with the club partially advanced;

FIG. 12 is a side view similar to FIG. 8 where the golfer is in the fifth of the eight positions of Drill 2, and continues executing a downswing;

FIG. 13 is a view similar to FIG. 8 where the golfer is in the sixth of the eight positions of Drill 2, and continues executing a downswing, fully advanced;

FIG. 14 is a view similar to FIG. 8 where the golfer is in the seventh of the eight positions of Drill 2, and is executing the follow-through, the club is partially advanced;

FIG. 15 is a view similar to FIG. 8 where the golfer is in the last of the eight positions of Drill 2, and completes the follow-through;

FIG. 30 is a view similar to FIG. 25 where the golfer is in the last of six positions of Drill 1*b* and is completing the follow-through;

FIG. 38 is a schematic front elevational view of a golfer practicing the method of the invention with the assistance of a tension belt applicable to certain n intermediate drills, namely Drills 1*c*–4*c*;

FIG. 39 is a schematic front elevational view of a golfer in the first of three positions of a further intermediate Drill, namely Drill 5;

FIG. 40 is a side view similar to FIG. 39 where the golfer is in the second of the three positions of Drill 5, with his hands at the top of the backswing;

FIG. 41 is a schematic front elevational view similar to FIG. 39 where the golfer is in the third of the three positions of Drill 5, hands at the top of the backswing;

FIG. 42 is a schematic front elevational view of a golfer practicing the method of the invention in the first of three illustrated positions of two further intermediate drills, namely Drills 6 and 7, being still further embodiments of the method of the invention;

FIG. 43 is a view similar to FIG. 42 where the golfer is in the second of three illustrated positions of Drills 6 and 7, hands at the top of the backswing;

FIG. 44 is a view similar to FIG. 42 where the golfer is in the last of the three illustrated positions of Drills 6 and 7, and is executing the follow through;

FIG. 47 is a view similar to FIG. 45 where the golfer is in the third of the three positions of Drill 9 and is executing the follow through;

FIG. 49 is a view similar to FIG. 48 where the golfer is in the second of the two positions of Drill 5*b* and is executing the follow through;

FIG. 51 is a view similar to FIG. 50 where the golfer is in the second position of Drill 7*b*, executing the follow-through;

FIG. 53 is a view similar to FIG. 52 where the golfer is in the second of the two illustrated positions of Drill 8*b* and is executing the follow through;

FIG. 55 is a view similar to FIG. 54 where the golfer is in the second of the two positions of Drill 9, executing the follow through;

FIG. 57 is a view similar to FIG. 56 where the golfer is in the second of the two positions of Drill 10, executing the follow-through;

FIG. 59 is a view similar to FIG. 58 where the golfer is in the second of the two positions of Drill 11 and is executing the follow through;

FIG. 60 is a schematic front elevational view of a golfer practicing the method of the invention in the first of two illustrated positions of a further intermediate drill, namely Drill 9*b*, showing a backswing, fully executed;

FIG. 61 is a view similar to FIG. 60 where the golfer is in the second of the two positions of Drill 10*b*, executing the follow through;

FIG. 62 is a schematic front elevational view of a golfer practicing the method of the invention in the first of two illustrated positions of a further intermediate drill, namely Drill 10*b*, showing a backswing, fully executed;

FIG. 63 is a view similar to FIG. 62 where the golfer is in the second of the two positions of Drill 10*b* and is executing the follow through;

FIG. 64 is a schematic side elevational view of a golfer practicing the method of the invention in the first of two illustrated positions of a further intermediate drill, namely Drill 11*b*, showing a backswing, fully executed;

FIG. 65 is a front view similar to FIG. 64 where the golfer is in the second of the two positions of Drill 11*b*, executing the follow through;

FIG. 66 is a schematic side elevational view of a golfer practicing the method of the invention in the first of two illustrated positions of a further intermediate drill, namely Drill 10*c*, showing a backswing, partially executed;

FIG. 67 is a front view similar to FIG. 66 where the golfer is in the second of the two illustrated positions of Drill 10*c*, and continues with the backswing;

FIG. 68 is a schematic top elevational view of a golfer practicing the method of the invention in the first of two positions of a rotational drill, namely Drill A, being an embodiment of the method of the invention FIG. 69 is a view similar to FIG. 68 where the golfer is in the second position of the rotational Drill A;

FIG. 70 is a schematic front elevational view of a golfer practicing the method of the invention in the first of two positions of a further rotational drill, namely Drill B, being an embodiment of the method of the invention FIG. 71 is a view similar to FIG. 68 where the golfer is in the second position of rotational Drill B;

FIG. 72 is a schematic front elevational view of a golfer practicing the method of the invention in the first of two positions of a further rotational drill, namely Drill C, being an embodiment of the method of the invention;

FIG. 73 is a view similar to FIG. 72 where the golfer is in the second position of rotational Drill C;

FIG. 74 is a schematic front elevational view of a golfer practicing the method of the invention in the first of two positions of a further rotational drill, namely Drill D, being an embodiment of the method of the invention;

FIG. 75 is a view similar to FIG. 74 where the golfer is in the second position of rotational Drill D;

FIG. 76 is a schematic top elevational view of a golfer practicing the method of the invention in a further rotational drill, namely Drill E, being an embodiment of the method of the invention.

DETAILED DESCRIPTION OF THE PREFERRED EMBODIMENTS

Figure 1:
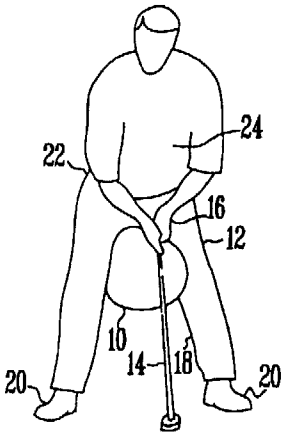
FIG. 1 is a schematic front elevational view of a golfer practicing the method of the invention in the first of seven positions of a first drill suitable for beginners, Drill 1, being one embodiment of the method of the invention.
Figure 2:
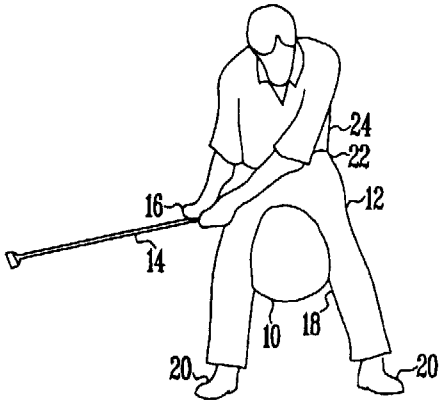
FIG. 2 is a view similar to FIG. 1 where the golfer is in the second of the seven positions of Drill 1, and is executing a backswing, club partially advanced.

The present invention includes certain novel physiological discoveries, observations, or insights relating to the achievement of a preferred swing of the arms for use in golf and other sports and activities employing a repetitive arm swinging motion where the accuracy, efficiency or power of the swing are important. While no device or method can guarantee success or improvement in the performance of a particular sport for everyone user, and the present invention does not provide any such guarantees, it is believed that the methods of the present invention, when practiced as described herein, will enable many people to learn good golf skills relatively easily, or to improve their existing skills significantly, and that the methods of the present invention can be beneficially applied to other sports and activities, with appropriate adaptations, as will be apparent to those skilled in the art.

The following description will refer to a male, right-handed golfer, by way of example, who will be assumed to be about six feet tall and about 175 pounds. The invention is of course applicable to women golfers, left-handed golfers and golfers of most heights and weight. Suitable adjustments or modifications of the invention for such other golfers will be readily apparent to those skilled in the art.

According to the findings of the invention, a swing training method should be biomechanically specific to an idealized or sport-characteristic swing pattern, which is expected to provide good performance, for example in golf a long and accurate shot, yet not sacrifice on the efficiency and intensity of the exercise of swinging the club. The swing training method disclosed herein, in preferred embodiments, is a sport-specific technique intended to train individual muscle groups naturally to perform specific components of a desired or preferred swing pattern, and possibly also to compensate naturally for mechanical disadvantages caused by a player's or athlete's bad habits or physical limitations.

Many known training methods for golf, or other sports, emphasize the development of muscle strength, with or without mechanical aids, by repeatedly contracting selected muscles against a resistance. Weight-lifting and bicycling used as training methods for many sports are examples. Swing training requires good control as well as muscle strength, or power, and to this end, some known training methods, for example, as described above, add constraining means to control the movement of body parts that some individuals have difficulty in properly aligning for the desired swing. Outwardly flying elbows are one example of hard-to-control body parts. In most prior methods little, if any, emphasis is placed on the need to elongate selected muscles and muscle groups. Selective muscle elongation can enhance leverage, and facilitate control and alignment of bodily elements to improve the swing.

The methodology of the invention addresses muscle elongation as well as muscle strength and relative positioning of relevant bodily components. Inter alia, the invention is designed to increase the mechanical advantage obtainable with the leverage system of the body through selective muscle elongation. The drills and exercises of the invention can help to break down resistance to such muscle elongation. When a player's leverage system is good, training using the methods of the invention, can enhance the results.

Preferred training methods according to the invention, train an elastic component of muscle tissue to enhance the elongation of selected muscles or muscle groups and provide a significantly improved mechanical advantage in the force applied to the golf ball. A preferred methodology of the invention employs a combination of drills or exercises which provides a sequential stretching of each muscle group involved in the swing.

The biomechanics of a golf swing may be analyzed into a number of component actions. Important swing component actions are rotations of the shoulder, the torso, the midsection and a stretching of the legs. The rotation of the shoulders stretches the torso muscles; the rotation of the torso stretches the midsection muscles; the rotation of the midsection stretches the hips; and the rotation of the hips stretches the leg muscles.

Key elements of good golfing skills lie in the movements of the hips and arms while swinging, and an ability to focus the eyes on the head of the club hitting the ball rather than in the intended direction of travel. The length of a golfer's drive is only partially determined by the force put into his shot. Important additional factors are an ability to maintain a preferred swing plane throughout execution of the golf swing and the leverage applied.

Terminology

As illustrated in FIG. 1A, complete golf swing has three component swing phases: a backswing BS, the movement from address, over one shoulder, to the top of the swing; a downswing DS, the movement from the top of the swing to the point of contact; and a follow-through FT, the movement from the point of contact over the other shoulder to the end of the swing.

As used herein a "preferred swing plane S" refers to a desirable plane of travel for a golf club as it moves in a golf swing and is a hypothetical plane defined by the movement of a line L passing along the length of the shaft. The "swing trajectory" is the actual path followed by the hands, shaft and club which need not be, and usually will not be planar. It is difficult to execute a swing on the preferred swing plane. Ideally, throughout the complete golf swing, a line passing through the hands shaft and club head remains in a single plane. This is virtually impossible to achieve, but is a valuable objective.

While the swing is most effective when golfers swing on the preferred swing plane, very few golfers are consistently able to do so because the effort is so demanding and considerable precision is required. Furthermore, body limitations, such as a lack of flexibility, make it difficult to reproduce a consistent swing pattern on a desired plane.

As used herein, the "swing arc", is the part-circular line defined by rotation of the fully extended left arm holding the club of choice about the left shoulder. The size of the swing arc is dependent upon the club used, so that the smaller the club, the smaller the swing arc. The swing arc is an idealized concept which cannot be fully attained in an actual swing.

As used herein, the "swing path" is the actual path on which the club head travels through the swing, which may be good bad or indifferent in any given swing. It is desirable for the swing path to coincide with the swing arc at the point of contact with the ball. Solid extension of the left arm while pushing the club into the preferred position starts and maintains a desirable swing path. Starting the club head on the preferred swing plane, initiates good timing and starts to build club head speed by providing a start to a maximum swing path.

Positioning or Setup for a Golf Swing

Starting body alignment or address is important to execution of a good swing and is preferably adopted in performing the exercises and drills of the invention. Good alignment begins with the transverse body lines through the shoulders, hips, knees and feet respectively extending parallel to a target line on which the ball is to travel. A center line between the shoulders, hips, knees and feet should aim just to the left of the target, or intended point of contact of the club head with the ball, with the leading edge of the club face set perpendicularly to the target line. The club should be set with the club head on the center line and with the shaft vertical and parallel to the center line, defining a desired shaft angle and shaft plane with it.

The placement of the golfer's feet before the swing is closely linked with the way he generates power during the swing. A preferred foot placement is obtained by setting the insides of the heels approximately shoulder width apart. If the stance is too wide, then turning freely and fully becomes difficult while if the stance is too narrow the golfer may lack stability and balance. Good balance reduces excessive muscle tension. Additionally, the golfer's knees should be slightly flexed to lower the center of gravity and keep the balance. This stance is helpful in several respects: in producing good torso rotation; in stretching the leg extensor muscles; in flattening the swing trajectory to conform more closely with the preferred swing plane; and in gradually absorbing force in the follow-through.

Execution of the Swing

In the backswing, the club head, the hands, and the shoulders should start in one motion. The weight of the feet in the stance is shifted laterally from the front foot to the rear foot (referring to the intended direction of travel of the ball). This shifting of weight increases the range of hip rotation and helps flatten the swing trajectory. As the weight is shifted to the back foot, lateral rotation at the left hip turns the pelvis away from the ball's flight. The golfer wants to keep the club on the preferred swing plane which is best represented as an imaginary line drawn along the shaft and extending through the end of the grip and the body. At the top of the backswing, the left arm should be above and parallel to the shaft plane created at address, and the club shaft should point just to the left of the target, on the target line. This posture optimizes the probability that the energy of the hips, shoulders, arms and hands will be released in the correct order, and a desirable chain reaction will result.

The position and motion of the wrists are also important factors in attaining maximum club head velocity. Uncocking of the wrists too early in the downswing will decelerate the arm motion, and decrease the angular velocity of the entire swing. Therefore, it appears that controlling the uncocking of the wrists to occur at an appropriate moment of the downswing is an important mechanical element of the swing.

Conforming closely to the preferred swing plane during the backswing helps the upper body and arms to be properly inter-aligned to pre-group forces so that each muscle group functions in a preferred sequence. The hands move the club and the swinging of the arms turns the shoulders. The downswing is inaugurated by the hips and the turning hips unwind the upper part of the body. The shoulders, arms and hands flow easily into the swing, without interference between their individual motions, pursuant to what may be referenced as a "summation of forces" principle.

Since it is the club head's momentum that drives the ball, the higher the velocity of the club head, the further the ball will go. The club head may be considered to be set ill motion by the body's musculature operating the osseous system as a series of levers, firmly articulated together, and functioning as a composite whole. The further away from the club head the power is applied, the more rapidly the head will move. The longer the lever provided by the arms, and the greater the arc determined by shoulder turn and trunk rotation, the greater the velocity of the club head. Also the nearer to the feet the power is applied, the more rapidly the club head will travel.

The more powerful muscles of the back, hips and legs are not used as much as the weaker muscles of the shoulders arms and wrists. The lônger the path taken by the club head in the backswing, the longer and flatter the downward swing trajectory path is likely to be. There is a variety of external anthropometric and biomechanical factors which can vary from person to person performing a golf swing. Flexibility, coordination, balance, strength and the ability to develop specific movements of the lower torso, trunk, hips and shoulders can all affect swing performance.

Pursuant to these principles, the present invention provides easily performed training methods and drills employing very simple apparatus, such as ordinary balls and the like, to control and work specific muscle groups to produce/promote a swing on plane.

Drills and apparatus

Some exemplary exercises and drills embodying the invention and which will be described in more detail hereinafter employ, in various modes and combinations, a number of items of training apparatus. In preferred embodiments, the training apparatus comprises a swingable elongated training implement and multiple body spacer objects, namely a large ball, a medium ball, a small hand ball and a small armpit ball to control the behavior of various body components during practice swings and drills, notably to prevent erratic limb movements and to help isolate the actions of different groups of muscles. Other simple apparatus such as a rigid bar and a tension belt can also be used to supplement or enhance the drills. The following are some examples of suitable dimensions and other characteristics for these various items of training apparatus.

Referring to FIG. 1B, a preferred "large ball" or "thigh ball" 10 should be suitable for gripping between the thighs while swinging and can have a diameter $D_{10}$ of from about 25 to 60 cm., preferably about 35 cm. to 55 cm., depending upon the physiology of the golfer, with a modest or insignificant weight, for example, under 1 lb. A large ball with a diameter of about 45 cm., a weight under 1 pound and with good resilience, being not readily deformed between the knees to a diameter less than 35 cm., is suitable for the male golfer described above. Such a ball may have the general physical characteristics of a beach ball of appropriate size. The action of gripping such a ball between the thighs while swinging locks the thighs together, controlling erratic leg movements and preventing undesired relative movement between the thighs and legs and helps isolate hip movements, enabling trunk or torso movements to be separated from hip movements. Preferably, the large ball is sized so that the user or player can comfortably grip it between the thighs without compromising their ability to execute a desired swing.

A "medium ball" 28 having a diameter $D_{28}$ of from about 2 to about 12 inches (about 5 to about 30 cm.), preferably from about 4 to about 10 inches (about 10 to about 25 cm.) and a weight of from about 0.5 to about 12 lbs. (or about 0.2 kg to about 5 kg.), preferably about 2 to about 10 lbs is used as an elbow or arm ball. The medium ball is gripped primarily between the elbows or forearms, serving to control erratic arm movements, to prevent undesired relative movement between the arms so that the shoulders can be moved in unison, to control erratic arm movements and to help separate shoulder movements from torso movements . A particularly preferred embodiment has a diameter of about 8 inches (about 20 cm.) and a weight of about 2.5 lbs. (about 1.1 kg.) Thus, a preferred medium-sized ball has a diameter that can be comfortably held between the elbows and a significant weight requiring a relatively strong gripping action to support the ball and providing significant resistance to swing exercises, promoting aerobic activity .

A "small ball" or "handball" 40 or 44, intended to be held in the hands in place of a club or simulated club, although it might conceivably have a diameter $D_{40}$ up to about 12 inches (30 cm.), will usually be smaller than the medium ball, and preferably a diameter of from about 2 to about 8 inches (about 5 to about 20 cm.) and a weight between about 2 and 10 lb (about 1 and 5 kg.) A particularly preferred embodiment is about 6 inches (about 15 cm.) in diameter and has a weight of about 2.5 lb (about 1.1 kg.). When gripped in the hands, the small ball helps with wrist control and can add resistance.

Both the small and medium balls can be medicine balls, notable for their weights modest deformability, or pliability and lack of resilience.

A "small armpit ball" 50 preferably has a diameter $D_{50}$ such that it can be gripped in or beneath the armpit, while still executing a satisfactory swing, for example between about 2 and 8 inches (about 5 and about 20 cm.) with a weight between about 2 and 10 lb (about 0.5 and about 5 kg.). A particularly preferred embodiment has a diameter of about 6 inches (about 15 cm.) and a weight of about 2 lb (about 0.9 kg.). The significant weight of the armpit ball ensures that substantial musculature contractions are required to grip it.

The swingable elongated training implement, also referenced herein as the "golf club" may be any standard golf club including 2, 3, 4, 5, woods and 1–9 irons. Preferred embodiments use a five iron or a simulated club. The shaft length is preferably from that of a 5 iron to that of a 7 iron. The longer the shaft, the more difficult the training exercises.

The weight of the small and medium balls, or equivalent significantly weighted objects, is preferably selected to provide a comfortable level of resistance that suits the trainee at a given time. With experience and development of swing-specific muscle strength, the trainee may adopt heavier balls offering more resistance.

The particular size of each body spacer object is preferably selected according to the physiology, and perhaps the skills, of the individual trainee, within the general ranges set forth above, to help comfortably position or guide the club on to a desired swing plane. The judgment as to what constitutes an optimally sized ball or other implement is probably best made by an experienced instructor. For example, in a drill employing a medium ball gripped between the elbows, a trainee having difficulty extending the club to a desired point of the backswing may more easily conform to the desired swing path with a slightly smaller ball. A reasonable degree of comfort is important: the muscles should be worked and stretched, but not uncomfortably strained. In general, subject to variations in proportions, the optimal size of each ball or other spacer object used will correlate with the height of the trainee, so that shorter trainees use smaller balls, and taller trainees use larger ones.

It is contemplated, though not preferred, that the methods of the present invention may be combined with, for example, tethering of a ball to the waist or other body part, either elastically or inelastically, or controlling the movement of the club head pursuant to Hundley or other and equivalent combinations.

While a variety of balls is described and shown as being useful implements in practicing drills and exercises according to the invention, it will be appreciated that equivalent objects, articles or devices may be used and provide many of the benefits of the invention, for example, flattened or substantially rectilinear, e.g. cubic objects or bridge-like objects or devices that maintain a desired separation between selected body anatomies, yet will be dropped if not properly gripped.

Preferred drills are performed with the specific actions detailed below. As a general principle, beginners execute only the first two swing phases, namely the backswing and downswing while the more advanced player will complete the swing with a follow-through. Preferably, the beginner and the advanced player should also perform each drill from the opposite side of the body to train the antagonist muscles. By performing the drills both ways, the muscles will be worked eccentrically, assist in greater acceleration and also greater deceleration. Each drill should be repeated about ten times on each side, before advancing to the next drill. The number of repeats is not critical and may be varied, for example between about six and about twenty depending upon the trainee, their conditioning, experience with the drills, and so on.

The invention extends to training programs employing preferred combinations of drills, as will be described hereinafter.

Beginner Drill 1

Referring to FIGS. 1–7, in beginner Drill 1, the golfer is shown with a large ball 10 between his thighs 12 and a simulated club 14 held is in the player's hand 16 ready to emulate a regular golf swing. The knees 18 should be flexed slightly. The feet 20 should be firmly place with toes forward, knee caps forward. See FIG. 1. Simulated club 14 comprises an annular weight secured to a club-length shaft to provide additional resistance beyond that of a golf club alone, for example THE DISTANCE BUILDER (trademark) as supplied by GNR, a 37-ounce base club, with securing collar for up to 31 additional ounces of weights.

Figure 3:
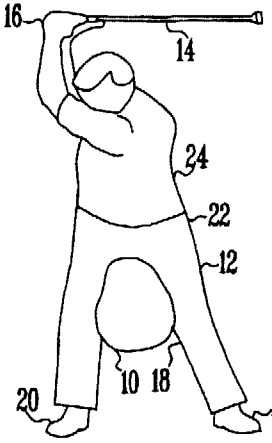
FIG. 3 is a view similar to FIG. 1 where the golfer is in the third of the seven positions of Drill 1, and continues executing a backswing with the club at the top of the backswing.
Figure 4:
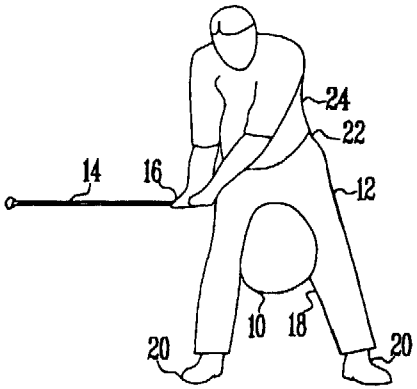
FIG. 4 is a view similar to FIG. 1 where the golfer is in the fourth of the seven positions of Drill 1, and is executing a downswing, club partially advanced.
Figure 5:
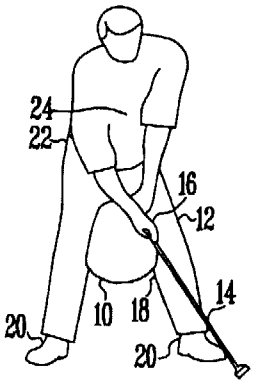
FIG. 5 is a view similar to FIG. 1 where the golfer is in the fifth of the seven positions of Drill 1, and continues executing a downswing the club frilly advanced.
Figure 6:
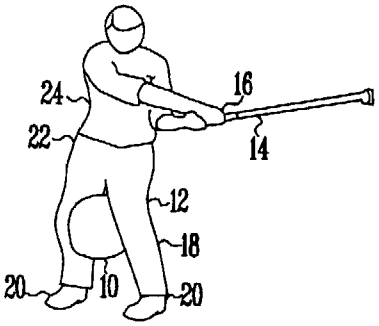
FIG. 6 is a view similar to FIG. 1 where the golfer is in the sixth of the seven positions of Drill 1, and is executing a follow-through, club partially advanced.
Figure 7:
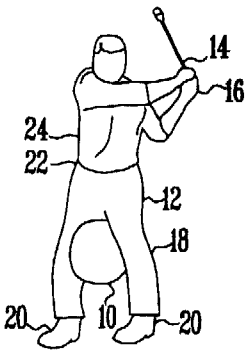

To isolate the lower trunk 22 rotation needed for golf, the player should execute a backswing. See FIG. 2 and FIG. 3 for backswing sequence. The player's feet are flat to the ground and turns are made using muscles of the trunk 22. Having the ball between the thighs naturally holds the lower body steady while allowing the player to rotate the trunk 22. FIG. 3 shows the stretch of the torso muscles 24. FIG. 4 and FIG. 5 together illustrate the downswing sequence. In the follow-through the player sets up the opposite side of the body training the antagonist muscles, as shown in FIG. 6 and FIG. 7. By performing this drill in both directions, returning from the completed follow-through position of FIG. 7 to the peak of the backswing shown in FIG. 3, the muscles are worked eccentrically, helping provide greater acceleration and deceleration in moving the club.

Beginner Drill 2

Figures 8, 9, 10, 11, 12, 13, 14, 15:
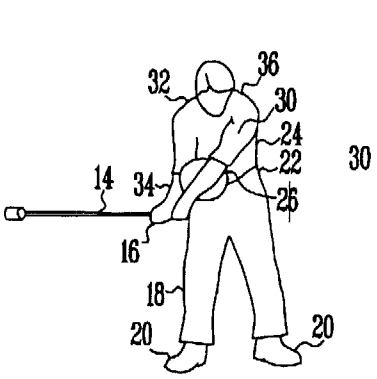

Referring to FIGS. 8 through 15, in beginner Drill 2, the golfer is shown with a medium-sized ball 28 placed between his elbows 26. The medium ball 28 between the elbows 26 controls the backswing path and prevents the player from starting the club head too far outside or too much inside the desired swing plane. The player keeps squeezing the ball 28 with his elbows 26, to support it, throughout the swing. This effort isolates and starts muscles on the arms, posterior shoulder girdle, middle, upper and lower back, and on the trunk contracting. The player starts to rotate his trunk muscles and a slight rotation of the hip follows, as shown in FIG. 9. The player focuses on keeping his left arm 30 adducted and elevated close to the body and up under the chin, as shown in FIG. 10. The player also focuses on the position of his right shoulder 32, hands 16 and wrist 34 to aiming to keep the club 14 in the desired swing plane. The shoulders should turn about a vertical axis, not a horizontal one. The golfer controls his stance so as not to bend either leg sharply or turn his trunk and hips, as shown in FIG. 11. The player's knees 18 are flexed, but not sharply bent. Hyperextending the right knee hikes the right hip which in turn makes the backswing too vertical, causing a compensatory movement during the downswing pulling the club across the face of the ball and, causing a hook shot. This drill prevents an unduly flat swing that may result if the elbows are brought inside too sharply, ensures significant shoulder turn which may be prevented by swinging the club head too far outside. This effect is shown in FIG. 9. The medium ball 28 limits the extent of the back swing by preventing the hands 16 from swinging behind, rather than up and over, the right shoulder 32, as shown in FIG. 10. This action significantly stretches the arm, posterior shoulder girdle middle and lower back in the specific region, as shown in FIG. 10 and FIG. 11. The player then completes the downswing as shown in FIG. 12 and FIG. 13. The drill initiates a preferred rotation of left shoulder 36 forward, rather than downward, which maintains a vertical axis keeping the swing center intact. More advanced players than rank beginners can will complete the follow through, as shown in FIG. 14 and FIG. 15. The drill is preferably performed front the opposite side to stretch muscles eccentrically and create symmetry in muscle movement so that the training is balanced.

Beginner Drill 3

Figure 16:
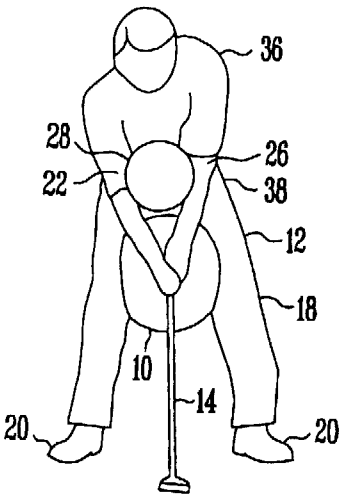
FIG. 16 is a schematic front elevational view of a still further embodiment of the invention showing a golfer practicing the method of the invention in the first of five positions of a third drill suitable for beginners, Drill 3, being a further embodiment of the method of the invention.
Figure 17:
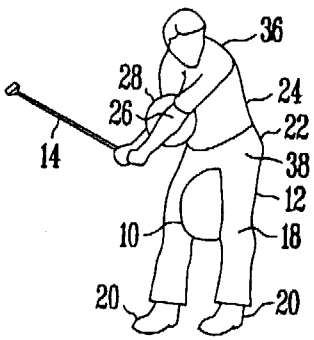
FIG. 17 is a side view similar to FIG. 16 where the golfer is in the second of the five positions of Drill 3, and is executing a backswing, partially advanced.
Figure 18:
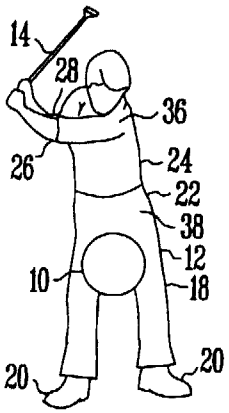
FIG. 18 is a view similar to FIG. 16 where the golfer is in the third of the five positions of Drill 3, and continues executing a backswing with the club at the top of the backswing.
Figure 19:
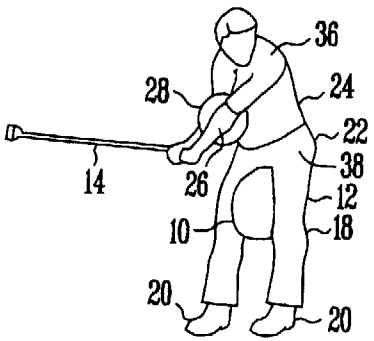
FIG. 19 is a side view similar to FIG. 16 where the golfer is in the fourth of the five positions of Drill 3, and is executing a downswing, club partially advanced.
Figure 20:
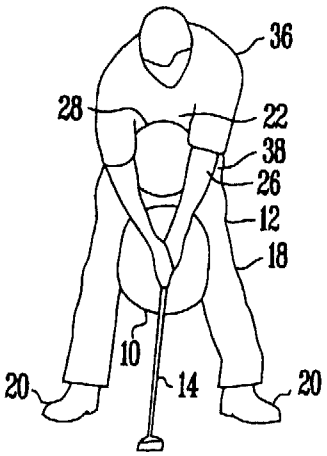
FIG. 20 is a view similar to FIG. 16 where the golfer is in the last of the five positions of Drill 3, and completes a downswing, club fully advanced.
Figure 24:
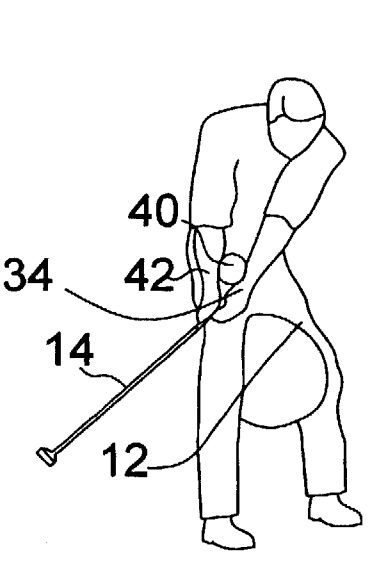
FIG. 24 is a side view similar to FIG. 21 where the golfer is in the last of the four positions of Drill 4, and is executing a downswing, club partially advanced.
Figure 22:
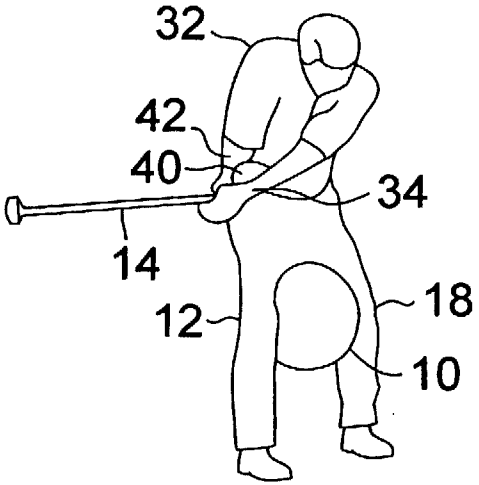
FIG. 22 is a side view similar to FIG. 21 where the golfer is in the second of the four positions of Drill 4, and is executing a backswing, club partially advanced.
Figure 21:
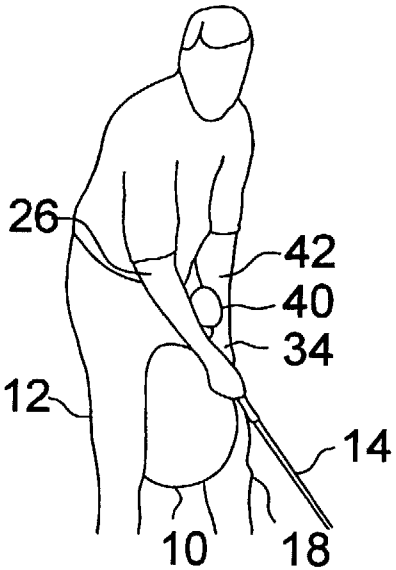
FIG. 21 is a schematic side elevational view of a still further embodiment of the invention showing a golfer practicing the method of the invention in the first of four positions of a fourth drill suitable for beginners, Drill 4.

Referring to FIGS. 16–20, in beginner Drill 3, the player is shown with a large ball 10 placed between his thighs 12. A second medium sized ball 28 is place between the elbows 26. The normal backswing is executed as shown in FIGS. 16–18. The player starts by rotating his trunk muscles 22. A slight rotation of hip 38 follows, as shown in FIG. 17. By keeping the knees 18 forward while rotating and adducting the left shoulder as you start and back swing, the balls assist in preventing the hips from moving laterally during the backswing. The drill allows the shoulders to turn at right angles to the spine and, initiates a turning of the shoulders "against" the hip 38 which starts a natural turn and pivot. The medium ball 28 prevents a full back swing and causes the positive contract/relax sequence to imitate the golf swing, as shown in FIG. 18. The downswing is completed as shown in FIGS. 21 and 22. The advanced player will continue to finish with the follow-through.

In addition to the combined benefits of Drills 1 and 2, Drill 3 helps maintain a vertical axis and saving center when the player's left shoulder 36 rotates forward and helps keep the knees in place. Furthermore, drill 3 prevents dipping of the left shoulder 36 and dropping of the knees 18 down and inward which would cause a lateral slide of the lips 38 and prevents the shoulders turning. Swaying sideways, where the right hip moves sideways rather than turning away from the ball, is the opposite of pivoting rotationally. Unless the shoulders turn and the hips are stationary as the club starts back, either the body sways laterally or the hips and shoulders turn together which prevents build-up of torque and hinders the generation of club head speed.

Beginner Drill 4

Figure 23:
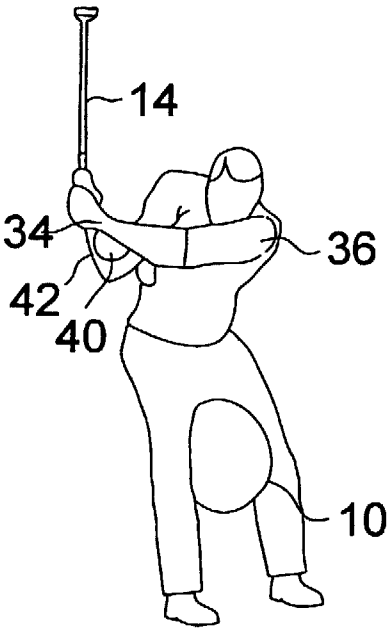
FIG. 23 is a view similar to FIG. 21 where the golfer is in the third of the four positions of Drill 4, and continues executing a backswing with the club at the top of the backswing.

Referring to FIGS. 21–23, in beginner Drill 4, the player places a small ball 40 between forearms 42, closer to the wrists 34 and a large ball 10 between his thighs 12. The player executes a backswing as shown in FIGS. 21 and 22. Gripping the smaller size ball 40 exerts greater stretching demands on the supernators and pronators muscles of forearm 42 and the adductor/abductor muscles of the shoulder girdle. The significance of the stretched foreman muscles can be felt in the trunk, middle and upper back, as well as the shoulder girdle.

This drill is an advanced version of Drill 2. The drill helps in the specific development and training of the forearms, shoulder and their use throughout the golf swing. The drill works specifically on the supernators and pronators of the forearms 42 to adapt them to the specific performance requirements of the golf swing.

Intermediate Drills 1*b*–4*b*

Referring to FIGS. 25 through 36, shown are drills 1*b*–4*b* for intermediate training. These drills are similar to the above sequence but instead of a training club in the player's hands 16, there is another small ball 44. Holding ball 44 in the hands keeps the wrists from over adducting at the top of the backswing.

Intermediate Drill 1*b*

Figure 25:
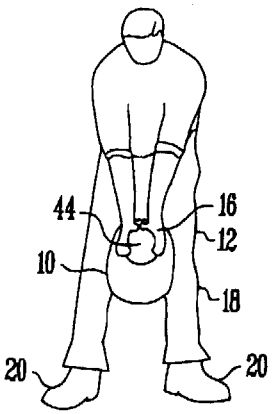
FIG. 25 is a schematic front elevational view of a golfer practicing the method of the invention in the first of six positions of a modification of Drill 1, namely Drill 1*b*, intended for intermediate players, or trainees, being a still further embodiment of the method of the invention.
Figure 26:
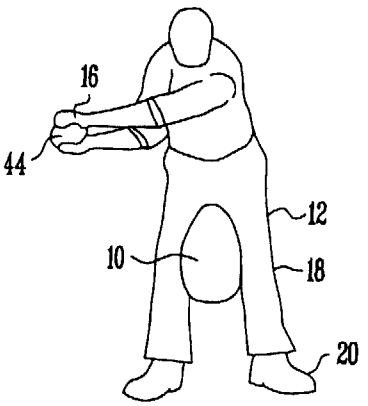
FIG. 26 is a view similar to FIG. 25 where the golfer is in the second of six positions of Drill 1*b* and is executing a backswing, club partially advanced.
Figure 27:
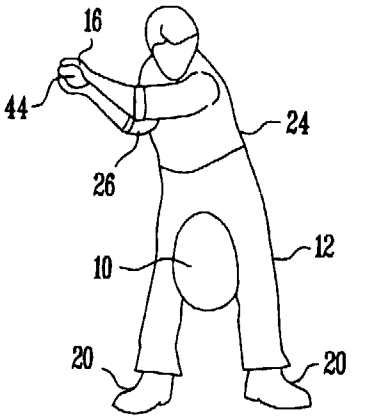
FIG. 27 is a view similar to FIG. 25 where the golfer is in the third of six positions of Drill 1*b* and continues executing a backswing with the club at the top of the backswing.
Figure 29:
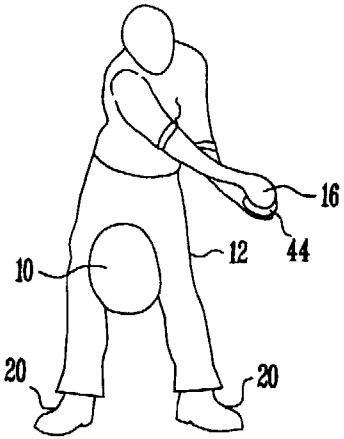
FIG. 29 is a view similar to FIG. 25 where the golfer is in the fifth of six positions of Drill 1*b* and is executing the follow-through, club partially advanced.
Figure 28:
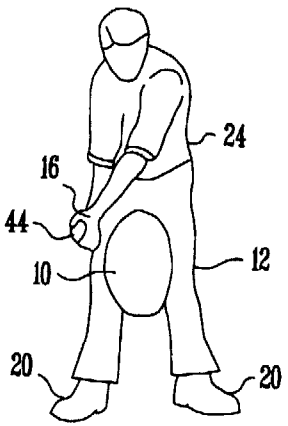
FIG. 28 is a view similar to FIG. 25 where the golfer is in the fourth of six positions of Drill 1*b* and is executing a downswing, club partially advanced.
Figure 30:
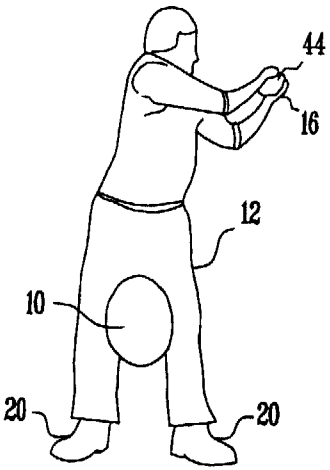

Referring to FIGS. 25–30, in intermediate Drill 1*b* the golfer is shown with a large ball 10 between his thighs 12 and a small ball 44 in his hands 16. The player executes a full swing including backswing as shown in FIG. 25 and FIG. 26, and downswing, as shown in FIG. 27. The advanced player continues with the follow-through, as shown in FIG. 28 and FIG. 29.

Intermediate Drills 2*b* and 3*b*

Figure 31:
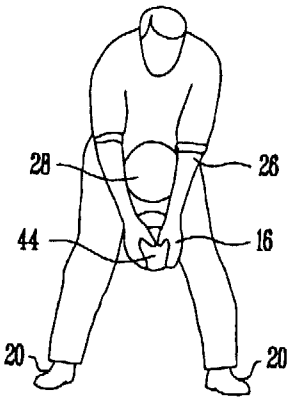
FIG. 31 is a schematic front elevational view of a golfer practicing the method of the invention in the first of three illustrated positions of a modification of Drills 2 and 3, namely Drills 2*b* (without a thigh ball, FIG. 31) and 3*b* (with a thigh ball FIG. 32), respectively, being drills intended for intermediate players, or trainees, and being a still further embodiment of the method of the invention.
Figure 32:
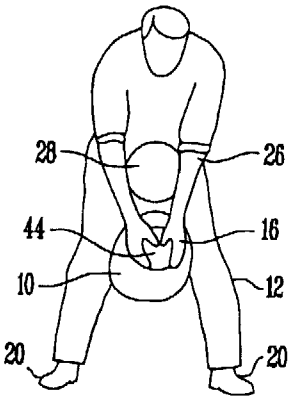
FIG. 32 is a schematic front elevational view similar to FIG. 31 of a golfer gripping a thigh ball between his legs.
Figure 33:
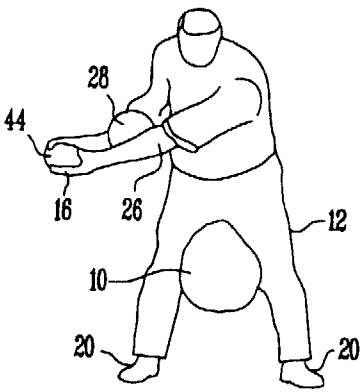
FIG. 33 is a view similar to FIG. 32 where the golfer is in the second of three illustrated positions of Drill 3*b* and is executing a backswing, club partially advanced.
Figure 34:
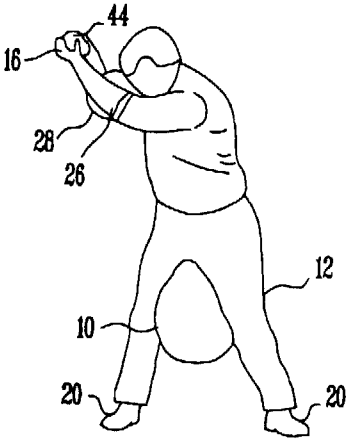
FIG. 34 is a view similar to FIG. 32 where the golfer is in the third of three illustrated positions of Drill 3*b* and the club is at the top of the backswing.

Referring to FIG. 31, in intermediate Drills 2*b* (without a thigh ball) and 3*b* (with a thigh ball), the golfer is shown with a medium ball 28 placed between his elbows 26 and a small ball 44 in his hands 16. Referring to FIGS. 32–34, the golfer is shown with a large ball 10 between his thighs 12, a medium ball 28 placed between his elbows 26 and a small ball 44 in his hands 16. The player executes a full swing including backswing as shown in FIG. 33 and FIG. 34, and downswing. The advanced player continues with the follow-through.

Intermediate Drill 4*b*

Figure 36:
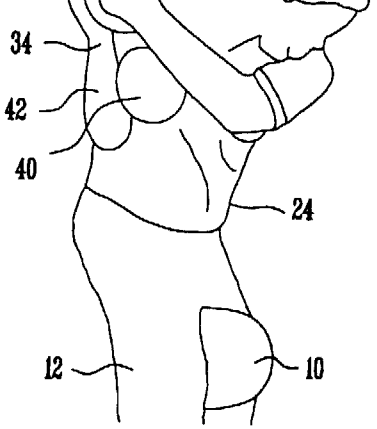
FIG. 36 is a view similar to FIG. 35 where the golfer is in the second of three illustrated positions of Drill 4*b*, with the club at the top of the backswing.
Figure 37:
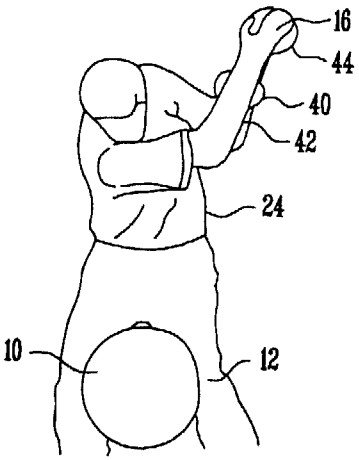
FIG. 37 is a view similar to FIG. 25 where the golfer is in the third of three illustrated positions of Drill 4*b*, executing a follow-through, club fully advanced.
Figure 35:
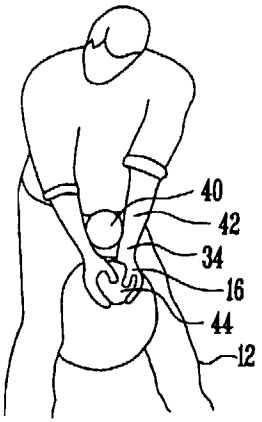
FIG. 35 is a schematic front elevational view of a golfer practicing the method of the invention in the first of three illustrated positions of an intermediate drill being a modification of Drill 4, namely Drill 4*b*, and being another embodiment of the method of the invention.

Referring to FIG. 35–37, in intermediate Drill 4*b*, the golfer is shown with a large ball 10 between his thighs 12, a small ball 40 between forearms 42 closer to wrists 34 there was the medium ball and a small ball 44 in his hands 16. The player executes a full swing including backswing with the extreme position as shown in FIG. 36 in side view, and continues with the downswing. The advanced player continues with the follow-through, as shown in FIG. 37.

Intermediate Drills 1*c*–4*c*

Figures 38, 39, 40, 41, 42, 43, 44:
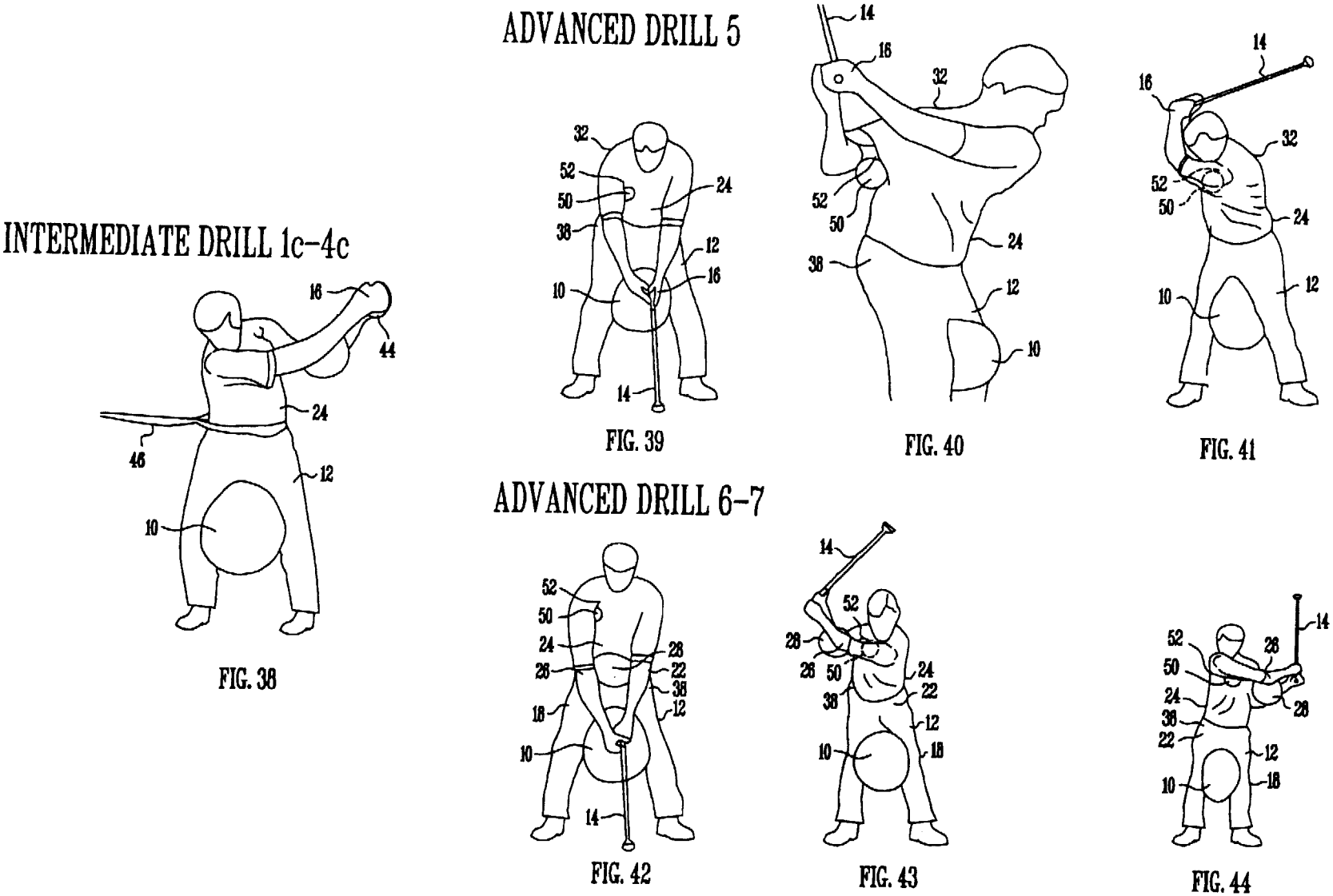

Referring to FIG. 38 which is similar to Drill 1*b*, the golfer is executing Drill 2*c*, shown with a tension belt 46 around his waist 48 executing a full swing pattern with a large ball 10 between his thighs 12 and a small ball 44 in his hands. Drills 1*c*, 3*c* and 4*c* follow the same pattern, respectively. Increase resistance to trunk and lower body offers greater gains in balance, coordination and enhances elongation potential of trunk, torso, shoulders and arms.

Advanced Drill 5

Referring to FIGS. 39–41, the player is shown with a small ball 50 under right armpit 52, a large ball 10 between his thighs 12 and a club in his hands 16. The small ball 50 under the right armpit 52 displaces the right shoulder 32 several degrees, thereby creating a longer leverage. The displacement imposes significantly greater extension on the left shoulder girdle, torso and trunk muscles. The amount of torsion that can now be generated on the correct swing position is significantly greater than is generated by swinging the club. The small ball 50 under the right armpit 52 also serves to keep the right elbow from flying out, and trains the external rotators of the right shoulder.

The player executes a backswing trying to keep the left arm tight to the body, as shown in FIG. 40. The player should attempt to adduct the left shoulder as high as possible up the body line. The backswing plane is inclined upwards from the point of contact with the ball, through the shoulder. As the arms approach hip level on the back, swing, they will move parallel with the plane and should remain parallel, or on the plane, throughout. The hands, arms and shoulder start the club back simultaneously. When the player cannot turn the shoulders nor rotate the trunk any further, they should try to squeeze the stretch a bit more, as shown in FIG. 41. As the shoulders turn, they start to turn the torso 24, which in turn starts to rotate the hips 38. This drill helps apply correct tension to the muscles between the shoulder 32 and hips 38 by retarding hip rotation in order to load musculature, like a spring. The constraints applied by gripping balls 10 and 50 ensures the effectiveness and specificity of the stretching of the posterior shoulder, upper, middle, lower back, trunk, hips and leg muscles. The preferred position of the elbow is maintained throughout the back swing. Muscle memory developed by this drill becomes inherently specific to the correct swing plane. The advanced player will continue with downswing and finish the follow-through.

This drill helps in maintaining a vertical axis and swing center about which the left shoulder rotates forward while keeping the knees in place. Keeping the knees forward while rotating and adducting the left shoulder as the player starts the backswing, helps to prevent the hips from moving laterally. Allowing the shoulder to turn at a right angle to the spine, initiates a turning of the shoulder against the hips which starts a natural turn and pivot. The drill also ensures balance and coordinates the entire body throughout the swing plane by keeping the weight off the toes.

Advanced Drills 6 and 7

Referring to FIGS. 42–44, which illustrates Drills 6 and 7, the player places a medium ball 28 between his elbows, a small ball 50 under his right armpit 52 and a club 14 in his hands. In the case of Drill 7, the player also places a large ball 10 between the thighs 12. Drills 6 and 7 are advanced drills which force the elbows 26 to adduct with external rotational forces being applied to the shoulder girdle as the elbows 26 are pressed to the ball. The player executes a full swing including backswing as shown in FIG. 43. The restrictions imposed by gripping balls 28 and 50 initiate the preferred take away sequence for the backswing keeping the arms parallel to one another throughout the back swing. Additionally, the restrictions help to prevent a flying fight elbow 26 and permit correct positioning of the club face at the top of the swing, as shown in FIG. 43, The player continues with the downswing. The drill also promotes preferred movement of torso 24 and good balance of the body throughout movement of the club through the swing plane. The advanced player will continue with the follow-through, as shown in FIG. 44. The drill facilitates a preferred finish to the swing by keeping the left elbow near 90° and the left shoulder adducted at approximately 90° at the finish with a strong finish of the right side, as shown in FIG. 44. When setting up from the left side with the small ball 50 under the right armpit, this drill promotes eccentric (negative work) training needed for deceleration of the club in the finish of the swing.

The elastic properties of the muscle specifically used in the arms and torso for the golf swing are trained by the methods of the invention in biophysically appropriate positions for golf. Muscle memory training is assured to be specific to the sport of golf. The ability to develop appropriate muscle memory in the backswing is also enhanced by the methods of the invention. The addition of the large ball 10 between the thighs 12, inhibits a lateral slide of the hips 38, which can produce a swing which is off-plane, and prevents the hip and the elbows 26 from providing all the necessary rotation. The large ball 10 also prevents the hips 38 and knees 18 from opening so far at address as to make it difficult to keep the shoulders square so that they, turn smoothly away from the back. This stance also controls the elbows and will prevent them flying outwardly. The positioning also ensures properly coordinated loading of the muscles of the arms, shoulders, torso and trunk on the backswing to have the effect of a coiled spring. Drill 7 also ensures excellent leverage, coordination and balance in the swing. In addition, drill 7 trains the trunk 22 to rotate at the right time to increase club-head speed and power at the point of contact with the ball.

Advanced Drill 8

Figure 45:
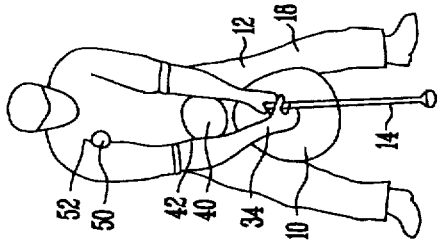
FIG. 45 is a schematic front elevational view of a golfer practicing the method of the invention in the first of three positions of a still further intermediate drill, namely Drill 9, being an embodiment of the method of the invention.
Figure 46:
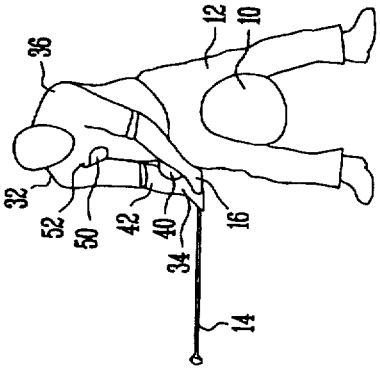
FIG. 46 is a view similar to FIG. 45 where the golfer is in the second of three positions of Drill 9 and is executing the backswing.
Figure 47:
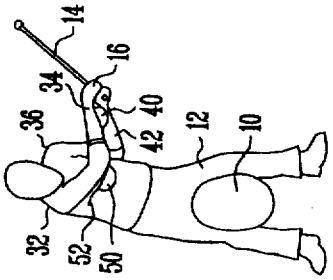

As shovel in FIGS. 45 through 47, for Drill 8 the player has a large ball 10 between his thighs 12, a small ball 40 between his forearms 42 positioned closer to the wrists 34 there was the medium-sized ball, a small ball 50 under his right armpit 52 and a golf club 14 in his hands 16. Placing the smaller ball 40 closer to wrists 34 increases the stretch and reflex capacity of the shoulders 32 and 36, arms, and torso 24, as shown in FIG. 46. The player executes a full swing including backswing. Drill 8 also helps prevent the wrist from "cracking", or turning over, too soon in the back swing. The restrictions imposed by gripping balls 50 and 40 keep the wrists and hands firm at the top of the back swing. The player should continue with the downswing. The drill promotes strength in wrists 34 and hands 16 throughout the swing. The advanced player will continue with the follow-through, as shown in FIG. 47. Drill 8 is an advanced version of Drill 6 and provides comparable benefits including promoting balance and kinesthetics.

Advanced Drill **5*b***

Figure 49:
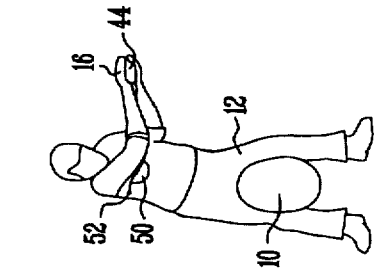
Figure 48:
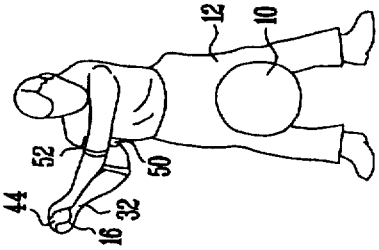
FIG. 48 is a schematic front elevational view of a golfer in the first of two positions, practicing still further intermediate drill, namely Drill 5*b*, being an embodiment of the method of the invention.

In Drill **5*b* illustrated in FIGS. 48 and 49, the player places a large ball 10 between his thighs, a small ball 50 under right his armpit 52, and a small ball 44 in his hands 16. The player will then execute a full swing including a backswing as shown in FIG. 48, and continue with the downswing. The advanced player will continue with the follow-through, as shown in FIG. 49. In addition to the benefits of Drill 5, the ball 44 in the hands 16** significantly controls actions leading to "casting" of the club, or twisting of the club head about the shaft at the top of back swing and at the initiation of the downswing. This stance helps to keep the wrists firm and strong and to increase endurance.

Advanced Drill **6*b* and 7*b***

Figure 50:
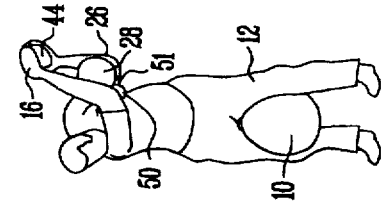
FIG. 50 is a schematic front elevational view of a golfer in the first of two illustrated positions practicing the method of the invention as embodied in a further intermediate drill, namely Drill 7*b*, shoving a reverse backswing, partially executed.
Figure 51:
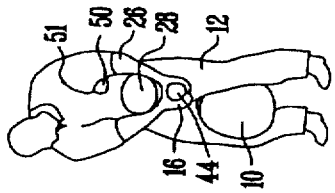

Referring to FIGS. 50 and 51, for Drill **6*b*, the player places a medium-sized ball 28 between his elbows 26, a small ball 50 under the right armpit 52, and a small ball 44 in his hands 16. For Drill 7*b*, the player additionally places a large ball 10 between his thighs 12. The player executes a full swing including backswing and downswing, and the advanced player will continue with the follow-through. In addition to the benefits of Drills 6 and 7, the large ball 10 between the thighs significantly increases the ability to separate the shoulder turn from the hip rotation, increasing coil-recoil side actions. Drill 6*b*** additionally increases the ease with which this separation takes place. There is also enhanced endurance and greater muscle memory.

Advanced Drill **8*b***

Figure 52:
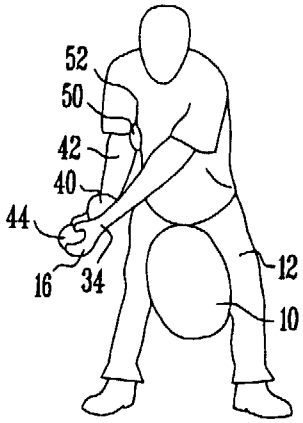
FIG. 52 is a schematic front elevational view of a golfer in the first of two positions practicing the method of the invention of a still further drill, drill 8*b*, shoving a backswing.
Figure 53:
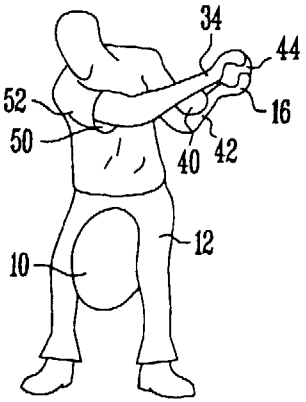

Referring to FIGS. 52 and 53, the golfer is shown with a large ball 10 between his thighs 12, a small ball 50 under the right armpit 52, a small ball 40 between forearms 42, relatively close to the wrists 34, and a small ball 44 gripped in his hands 16. The player executes a full swing including backswing and, downswing and an advanced player continues with the follow-through.

The drill improves strength and muscle endurance and promotes a strong grip at the start of the swing since by gripping ball 44 the left hand is trained not to loosen and drop the club head at the start of the downswing, as shown in FIG. 53.

Advanced Drill 9

Figure 54:
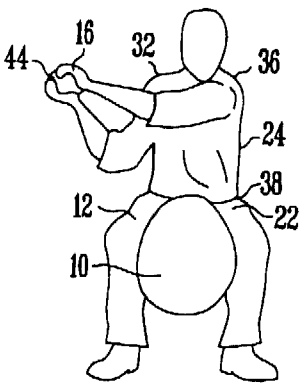
FIG. 54 is a schematic front elevational view of a golfer practicing the method of the invention in the first of two illustrated positions of a further intermediate drill, namely Drill 9, showing a backswing, fully executed.
Figure 55:
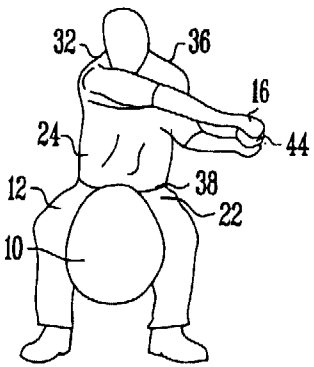

Referring to FIGS. 54 and 55 which illustrate Drill 9, while in a normal sitting position on mats or the edge of a chair, the player grips a large ball 10 between his thighs 12 and a small ball 44 in his hands 16. The player executes a full swing including backswing and downswing and an advanced player will continue with the follow-through. This drill is done seated to anchor the hips 38 and provide a sense of how separating or isolating action of the shoulders 32 and 36 from the movement of the hips 38, feels as shown in FIG. 54. More specifically, this position isolates the torso 24 and shoulders 32 and 36. Further training advantages are obtained where the arms load the shoulders and torso, the torso increases the load on the trunk 22, and the trunk loads on the hips 38. This action trains the upper body to turn independently of the hips and separates shoulder movement from hip movement for a more fluid action. This exercise is especially effective in negating a lateral slide of the hips 38 in the swing and preventing an inward collapse of the left knee. Drill 9 and the other drills and; exercises of the invention are advanced drills promoting growth of an individual's neurophysiological potential.

Advanced Drill 10

Figure 56:
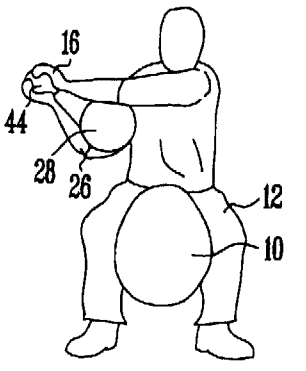
FIG. 56 is a schematic front elevational view of a golfer practicing the method of the invention in the first of two illustrated positions of a further intermediate drill, namely Drill 10, showing a backswing, fully executed.
Figure 57:
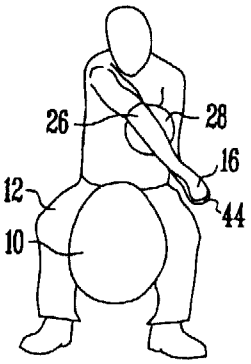

Referring to FIGS. 56 and 57, while seated as described, the player grips a large ball 10 between his thighs 12, a medium ball 28 between his elbows 26 and a small ball 44 in his hands 16. The player executes a full swing including the backswing and downswing and an advanced player continues with the follow-through. Drill 10 combines advanced upper body drills with the isolation of the lower body. The drill increases the body's potential to develop desirable neurophysiological properties. The muscle strength and muscle endurance of the upper body can be increased in a manner specific to the needs of an effective golf swing.

Advanced Drill 11

Figure 58:
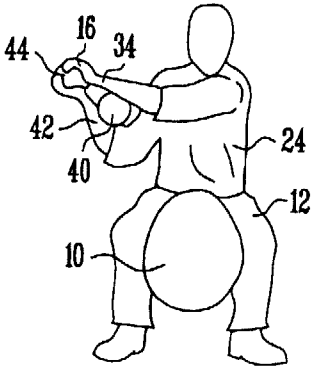
FIG. 58 is a schematic front elevational view of a golfer practicing the method of the invention in the first of two illustrated positions of a further intermediate drill, namely Drill 11, showing a backswing, fully executed; being an embodiment of the method of the invention.
Figure 59:
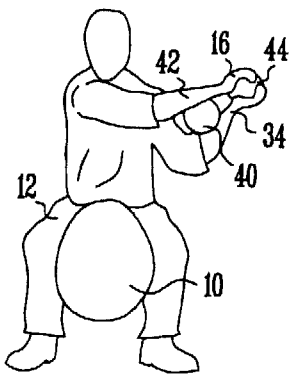

Referring to FIGS. 58 and 59, Drill 11 is also performed while seated. The player grips a large ball 10 between his thighs 12, a small ball 40 between his forearms 42, close to the wrists 34, and a small ball 44 in his hands 16. The player executes full swing including backswing and downswing and an advanced player continues with the follow-through. Drill 11 is an advanced version of Drill 8 providing comparable benefits. Additionally, training benefits can be realized from greater control of the motion of the upper body, with the lower body being isolated. Training gains in strength and muscle endurance can be obtained by constraining movement to be close to preferred sport-specific planes appropriate for golf.

Advanced Drill **9*b***

Referring to FIGS. 60 and 61, Drill **9*b* is also performed while seated. The player grips a large ball 10 between his thighs 12, a small ball 50 under right armpit 52, and a small ball 44 in his hands 16. The player executes a full swing including backswing and downswing and an advanced player continues with the follow-through. The benefits of Drill 9 are augmented by the greater reach and leverage obtained by displacing the right shoulder 32 with the ball in the right armpit 52, as illustrated by FIG. 60. Drill 9*b*** additionally provides gains in flexibility of the upper body by isolating the lower body.

Advanced Drill **10*b***

Referring to FIGS. 62 and 63, Drill **10*b* is also performed while seated. The player grips a large ball 10 between his thighs 12, a medium ball 28 between his elbows 26, a small ball 50 under his right armpit 52 and a small ball 44 in his hands 16. The player executes a full swing including backswing and downswing and an advanced player continues with the follow-through. The drill combines the benefits of Drill 10 with those of isolating the lower body, allowing a significant concentration of work in the upper body. Such training exercise have the potential for an individual to develop greater shoulder turn and separation of shoulder turn from hip rotation, as shown in FIG. 62. Than by Drill 10 alone. Drill 10 further enhances the tunability of the torso 24** while permitting a preferred sequence of upper body muscle contractions and extensions through a greater range of movement, to power the club through the desired swing plane.

Advanced Drill **11*b***

Referring to FIG. 64 and 65, Drill **11*b* is also performed while seated. The player grips a large ball 10 between his thighs 12, a small ball 50 under the right armpit 52, a small ball 40 between the forearms 42, close to wrists 34, and a small ball 44 in his hands . The player executes a full swing including backswing and downswing and an advanced player or trainee continues with the follow-through. In addition to the benefits of Drill 11, Drill 11*b* helps the elbows 26 to maintain preferred posture throughout the swing plane. The positioning of ball 40 ensures the same spacing between the elbows 26 throughout the full swing. Additional possible benefits from training with this drill include greater control of the club 14 and stronger hands 16 and wrists 34**.

Advanced Drills **9*c*–11*c***

FIGS. 66 and 67 show Drill **10*c*, where the golfer is shown seated with a tension band (optional) and a small ball 44 in his hands while, in the manner of Drill 10*b*, executing a full swing pattern with a large ball 10 between his thighs and a small ball 44 in his hands. Drills 9*c* and 11*c* follow the same pattern, respectively practicing Drills 9*b* and 11*b* with the enhancement of tension belt 4*b***.

Rotational Drill A

Referring to FIGS. 68 and 69, which illustrate Rotational Drill A the player lies on a hat with one medium ball 128 gripped between the knees 18 and another medium ball 28 gripped between the hands . The player extends his hands 16 and the ball 28 in one direction and his knees 18 and ball 128 in the opposite directions, rotating his hips 38, as shown in FIG. 68. Then the player, keeping his hips 38 and feet in place, rotates his hands and knees too the opposite position as shown, in FIG. 69.

This advanced drill can isolate the shoulders to separate the shoulder turn from hip rotation, and can induce a firm hand-wrist action. There is also increase control of trunk rotation. Drill A can assist preferred left shoulder adduction and right shoulder external rotation while executing the full swing. Trunk rotation is enhanced, as is diagonal stretching across back. The additional use of a tension band can enhance the extension capabilities of the oblique, upper back, posterior and anterior shoulder and arm muscles. The exercise additionally helps create a balance/symmetry in muscle flexibility.

Rotational Drill B

Referring to FIGS. 70 and 71, Rotational Drill B is performed while seated. The player grips a large ball 110 between his arms (hugging the ball) and turns his hips 38 clockwise, then counterclockwise, as shown in FIG. 70. This drill isolates or anchors the lower body and focuses and creates specific rotation effort on the trunk, in a manner specific to and appropriate for a desirable golf swing. There is also a diagonal stretching effort created across the back. Keeping the elbows 26 at approximately 90° at the trainee's sides also helps to isolate the trunk. The player may add a tension belt 120 his hands 16 for an added workout, as shown in FIG. 71. To increase the stretching potential of the torso, trunk, upper middle back.

Rotational Drill C

Referring to FIGS. 72 and 73, Rotational Drill C is also performed while seated. The player places two small balls 130 and 132 served inches, e.g. 4 to 6 inches, beneath each armpit. Holding a rigid bar 134 behind the neck, the player turns his shoulders clockwise, then counterclockwise. This is an advanced rotational drill to assist in retraction/adduction of scapulae, positioning of the shoulders in a desirable paired rotation about the spine while creating a separation of shoulder turn from hip rotation. The positioning also creates a diagonal stretching and rotational movement of the musculature throughout the torso and the trunk while hip rotation is prevented. Balls 130 and 132 under the armpits force the player to keep his elbows 26 from flying out during the drill, facilitating preferred elbow control in an actual golf swing. Training with Drill C can enhance posture, balance and coordination.

Rotational Drill D

Referring to FIGS. 74 and 75, Rotational Drill D is performed in a standing position. The player, or trainee grips a large ball 10 between his thighs 12 and another large ball 110 between his arms (hugging the ball). He rotates his shoulders back and forth. Drill D is an advanced version of Drill B. Keeping the large ball 10 between the thighs helps to separate trunk/hip rotation and the shoulder turn. The goal of the drill is primarily to advance beyond Drill B and prepares the golfer for the more rigorous training of the advanced golf drills, as noted herein, including, for example, follow-through swings. This drill gives the golfer a feeling of good balance, coordination, stability and preferred foot work, namely, minimal foot movement.

Rotational Drill E

Referring to FIG. 76, Rotational Drill E is performed while lying on a mat. The player grips a medium ball 28 between the knees 18 and a small ball 44 between the hands 16. The player extends his hands 16 and arms in one direction and his knees 18 in the opposite direction. Drill E is an advanced version of Drill A. The small 44 in the hands helps to increase the range of motion of the shoulder girdles, and of the rotation of the trunk and torso. The exercise keeps the elbows 26 spaced apart in a position specifically suited to golf and increases the adduction potential of the shoulders, while maintaining the separation of the trunk and shoulder movement desired for the performance of an actual golf swing. The exercise enhances the ranges of movement of specific groups of the musculature in ways that are specific and appropriate for a preferred golf swing.

Benefits Obtainable with Drills According to the Invention

When practiced as described herein, the benefits listed in Table 1 are intended to be obtainable with specific ones of the above-described drills, as set forth in Table 2, although some players or trainees may take longer than others to realize desired benefits. Depending upon the player's skill, and the thoroughness with which they practice the drills, some people may obtain benefits in as little as two weeks, while others will require four weeks, eight weeks or more to obtain desired benefits. The drills should be performed according to a program which is carried out at least twice a week, and preferably daily, and in which each drill in the program is executed from six to twenty times, preferably about ten times, before executing the next selected drill.

While a program comprising a small number of repeated drills may itself be repeated once or twice during in any given day, for most people an extensive program of drills will be too rigorous to be carried out more than once a day. Professional golfers may be an exception.

TABLE 1

| List of Benefits |
|---|
| A Starts the hands and club head on the right swing path for a maximum swing arc. |
| B Maintains a pivotal position for the shoulder turn and helps prevent swaying. |
| C Starts a "coil-recoil" action of the upper and lower body by causing a natural separation of shoulder turn and hip rotation. |
| D Prevents "lateral sliding" of hips. |
| E Prevents "casting" of club head by developing a natural and firm hand-wrist action. |
| F Prevents a "flying" right elbow. |
| G Promotes an increase of power in the swing without "muscling" the club. |
| H Promotes strong, active legs and firm, balanced footwork. |
| I Initiates good timing rhythm of the swing sequence by preventing a fast backswing. |
| J Promotes a powerful, balanced high finish of the swing plane. |
| K Prevents the upper body rather than the lower body starting the downswing due to an incomplete shoulder turn. |
| L Prevents an incorrect or loose grip and separation of hands while swinging. |
| M Prevents a quick wrist break and collapsing left wrist. |
| N Prevents bending of the left arm at top of swing. |
| O Prevents dipping or bending of the left knee when the backswing starts. |
| P Prevents separation of the arms while swinging. |
| Q Helps move weight lodged on right side. |
| R Prevents starting club head sharply inside on a flat swing plane. |

The disclosed drills are beneficial in that careful practice of each separate drill can achieve a significant number of the benefits set forth in Table 1. Relevant benefits potentially obtainable with each drill are listed in Table 2 below.

TABLE 2

Benefits Obtainable with Specific Drills

| Drill | Benefits |
|---|---|
| 1, 1b | C, D, G, H, J, K, L, N, O, P, Q |
| 2, 2b | A, B, E, F, I, K, M, P, R. |
| 3, 3b | A, B, C, D, E, F, G, H, I, J, K, L, M, N, O, P, Q, R |
| 4, 4b | A, C, E, F, G, I, K, L, M, N, P, R |
| 5 | A, B, C, D, F, G, H, I, J, K, L, M, N, P, R |
| 6 | A, B, C, D, E, F, G, H, I, J, K, L, M, N, O, P, Q, R |
| 7 | A, B, C, D, F, G, H, I, J |
| 8 | A, B, E, F, G, H, J |
| 5b | A, B, C, D, E, F, G, H, I, J |
| 6b | A, B, E, F, G, H, I, J |
| 7b | A, B, C, D, E, F, G, H, I, J |
| 8b | A, B, C, D, E, F, G, H, I, J |
| 9 | A, B, C, D, E, G, J |
| 10 | A, B, C, D, E, G, J |
| 11 | A, B, C, D, E, F, G, I, J |
| 9b | A, B, C, D, E, F, G, H, I, J |
| 10b | A, B, C, D, E, F, G, I, J |
| 11b | A, B, C, D, E, F, G, I, J |
| A | A, B, C, D, E, F, G, K, L, M, N, O, P, R |
| B | B, D, G, K, Q |
| C | B, C, D, F, G, I, K, O |
| D | B, C, D, G, H, J, K, O, Q |
| E | A, B, C, D, E, F, G, K, L, M, N, O, P, R |

Assiduous training with the above-described drills employing various sizes and numbers of balls each gripped between relatively pivotable parts of the body enables specific golf skills to be imitated with resistance. Golf-specific strength and control can be developed enhancing the ability of the player or trainee accurately to swing a golf club on a desired swing plane.

When, by successfully practicing the method of the invention, a golfer can ensure that his shoulders, arms and hands follow an appropriate route to move the club through the desired swing plane, it follows that the upper body and arms will be correctly inter-aligned at the top of the backswing to deliver a powerful and accurate downswing. The spring is coiled. The downswing is inaugurated by the hips 38 which, as they turn, unwind the upper part of the body, the shoulders, then the arms, and then the hands flow easily and powerfully into the swing, uncoiling the spring. By developing the backswing phase of his swing with the method of the invention, a player controls his muscles so that each body component of the downswing, the hips, shoulders, arms, and hands release their energy in sequence, resulting a desirable chain action. For a golfer with a "correct" swing, fully developed by conscientiously practicing the drills of the invention, who stays on his back swing phase and stores his energy effectively, golf is a tremendous pleasure. =p The drills can be aggressively efficient, especially when performed under the scrutiny of an instructor. High levels of concentration and intensity further enhance the method. Many golfers can feel benefits from the drills employing a medicine ball almost immediately. Because results are soon apparent, any initial apprehension a trainee may have, disappears quickly. Benefits can accrue to people of all shapes and sizes and of various levels of physical ability.

Since each drill is derived front a careful analysis of a desirable golf swing, in the process of performing the exercises of the invention, a golfer can quickly develop an understanding of the particular mechanics and specific physical requirements of being a successful striker of the ball. This growing awareness of fundamentals helps motivate a golfer to progress from the beginner's drills to the more advanced drills.

A further advantage of the method of the invention is that, unlike some known methods, it may be used during the golfing season without having adverse effects on the golfer's immediate performance.

Yet another advantage of the exercise methods of the invention, is that they do not require endless repetition in any given session, but have a well directed, specific effect on targeted groups of muscles. Thus, once the muscles specific to the sequence of the swing phase being exercised, are overloaded, become heavy and tired, the useful limit of the drill in that session has been reached and there is little additional benefit to be gained by further repetition. The exercises are quite functional in the sense of acting specifically on the particular groups of muscles required for executing a desired swing phase.

Preferred Drill Sequences and Combinations

The various individual drills and exercises of the invention can be combined into preferential sequences of drills to provide progressive training of the golfer's body. Many of these sequences will be apparent from the foregoing detailed description of the drawings and the sequence of drills presented can be regarded as a most preferred sequence, due allowance being made for the described options for beginners, advanced golfers or trainees and so on.

Thus, for example, it is desirable to begin at the foundation with a drill or a set of drills employing in various combinations, a large ball between the thighs to build stability and hip control; a medium ball between the elbows to control arm placement, along with a golf club in the trainee's hand. As the trainee progresses in skill, the drills may further employ a small ball between the hands, a small ball between the forearms, and a ball under the armpit. The more advanced player will progress to seated positions to isolate the upper body training. As described, it is desirable for the beginner to confine their exercises to the backswing and downswing phases and not to attempt a fully extended follow-through until an otherwise complete sequence of upright drills has been mastered. Rotational drills for trainees at any stage may be used to supplement the training program, depending on the individual's needs. It is of course understood that additional forms of exercise or therapy may be used to promote muscle functionality to maximize the benefit of the drill combinations.

Theoretical Considerations: Physiological Effects

While this invention is limited only by the accompanying claims and is not bound by any particular theory, the following discussion of theoretical considerations may be helpful in better understanding the invention and its equivalents. The drills and exercises described herein target the core or trunk of the body to enhance balance and power pursuant to the belief that a strong core is essential to stabilize the body and maintain stability during the performance of a golf swing. A stable core also serves to transfer forces from the legs to the shoulders and arms which deliver power to the clubhead. Almost every drill, directly or indirectly, works the core area of the body.

Biomechanically considered, specific groups of muscles providing individual movement patterns of flexing, extension, and rotations in multiple planes of motion are worked extensively, selectively and efficiently. Specific groups are trained both in isolation and in combination to form the patterns of the preferred swing plane for golf. Desirable sequences of movement-specific muscle actions generating movements that are components of a desired golf swing are closely imitated with resistance being provided by gripping a ball of significant weight.

The drills of the invention are functionally specific in the sense that the precise movements they foster are tailored to be specific to a desired or idealized golf swing and to placing not only the hands and club, but also other components of the body's anatomy that participate in the execution of golf swing, including the elbows, shoulders, torso, hips, knees and feet, in precise spatial locations and orientations relative to a desired line of flight of a ball to be struck. The particular motions that are trained may, when their precise geometry is considered, not be suited to other tasks such as swinging a baseball bat or tennis racquet or throwing a medicine ball. However, the methods of the invention can be adapted to saving training for other sports or activities where a precisely executed, powerful swing is important, as will be apparent to those skilled in the art, based upon the disclosure herein.

From a physiological point of view, medicine ball training is conventionally an anaerobic activity. However, the way in which medicine balls are used in the methods of the invention provides a combination of aerobic and anaerobic work which is sport-specific to the particular demands of golf.

The neuromuscular system is stressed by the intensity of the workout entailed in repeating individual drills and its development is enhanced by permitting a proper recovery period between drills or exercises, depending upon the trainee, from 1 to 10 minutes between each drill, after executing a selected number of repetitions. Programs of drills according to the invention, stimulate desirable muscle contractions and relaxations throughout the activity.

Theoretical Considerations: Muscle Behavior

Knowledge of muscle behavior can also contribute to an understanding of the invention. The inventive training methods utilize what are known as plyometric principles of exercise. "Plyometrics" refers to exercises in which powerful muscular contractions are generated in response to rapid dynamic loading, or stretching, of the involved muscles. As a means of developing explosive power applied in a desired-swing phase, plyometric training places fewer physical demands on the body than do strength or endurance training. A golf swing, to be effective, should not only be powerful but should also generate club head speed on plane.

Conventional training for strength and explosiveness, based for example on lifting weights or throwing and catching medicine balls, emphasizes methods that may be high in force production but are relatively slow in speed.

Externally imposed stretching of a muscle induces a reflex contraction opposing the stretching, a phenomenon know as a stretch reflex. The stretch reflex is a central nervous system response that stimulates a forceful contraction of the stretched muscle fiber. It is additional to any elastic recoil attributable to the inherent elasticity of muscle fibers which is analogous to the effect of stretching a thick rubber tubing. During the backswing phase of drills pursuant to the invention, when properly executed, the muscles are stretched by an imposed force (an opposing muscle group), than that to which they are accustomed, inducing a stretch reflex which resulting facilitates the recoil of elastic tissue. It follows that a carefully timed muscle stretch, followed immediately by a muscle contraction, produces greater force due to a combination of elastic recoil and the stretch reflex, a combination reflex.

Benefits related to the combination reflex principle can be further developed by increasing the flexibility of the muscle groups, enabling a golfer to store more coiled energy in his upper body. The further a person can rotate this shoulders away form his target, the farther the club head has to travel to the ball and the more club head speed can be developed leading to an increased distance of the shot.

Increased flexibility in both agonist and antagonist muscles participating in the golf swing will allow a golfer to develop a more appropriate and preferred swing in which the muscles used in the swing, specifically legs, hips, trunk, upper and lower back shoulder, arms and wrists are trained specifically to their use in the golf swing.

The apparently simple methodology of the inventive training system employs proprioceptive neuromuscular facilitation training which is based upon inhibition of muscular sensory activity to reduce muscle tension, and remove resistance to elongation. Maximal relaxation permits maximal elongation. Reciprocal simultaneous relaxation of the agonist, is a normal physiological occurrence which permits efficient and smooth joint motion. Furthermore, if the connective tissue muscle tendon unit is already elongated when the muscle contracts, then the net effect is that the muscle pulls on and stretches the connective tissue framework as the muscle shortens.

In summary, the methods of the invention enhance power, strength endurance, kinesthetics and dynamic balance. Power is enhanced by exercising against resistance with speed. The inventive swing training method takes advantage of naturally occurring plyometric effects herein the normal elasticity of the muscle is enhanced by the stretch reflex to exert more force in response to stretching loads. This is a highly trainable quality which is greatly enhanced by the drills. Endurance is enhanced by having a trainee repeat the specific movements with medicine ball resistance while fatigued. Such endurance enhancement is a significant component of a successful training method for a sport as demanding as golf, increasing a golfer's chances of maintaining a good swing throughout an entire round of golf.

While described as a training method suitable for self-implementation with appropriate instructional aids, it will be appreciated that the invention extends to methods of teaching a good or correct swing for golf or other sports which includes putting a ball or other training aid in position for the trainee to grip, as described, communicating and supervising the movements to be made and providing corrections, selections of drills, explanations and so forth.

While the invention has been described with particular reference to embodiments relating to the sport of golf, those skilled in the art will appreciate that the invention can be applied to other sports and activities where an accurate and powerful swing is required, especially those sports employing a two-handed swing, for example, baseball, hockey and cricket. The desired swing planes will be different as befits the respective sport, as will the setup or approach to the swing. Somewhat different sizes of balls or other training implements may also be appropriate to guide the swung bat, stick or the like to the desired swing plane. Other adjustments will occur to those familiar with the particular sport or other equivalent activity having regard to the teachings herein.

INDUSTRIAL APPLICABILITY

The invention disclosed herein is susceptible to industrial application in sports training industries for example in golf, tennis, baseball, hockey or cricket clubs and clinics or privately, under the supervision of a professional trainer. The invention can also be realized as kits for self training, the kits comprising a set of training implements, e.g. a ball of each of the types described herein, accompanied by suitable training material selected for example from an instruction manual, a videotape, computer disk, computer multi-media material or means to access remote electronic informational objects.

While some illustrative embodiments of the invention heave been described above, it is, of course, understood that various modifications will be apparent to those of ordinary skill in the art. Such modifications are within the spirit and scope of the invention, which is limited and defined only by the appended claims.

I claim:

1. A method of swing training for a sport requiring swinging of an elongated sports implement gripped between a player's hands while standing upright, the sports implement being swung backwardly in a backswing motion and forwardly in an opposed downswing motion to project a projectable object in a forward direction with respect to the player, the backswing motion being executed with a shifting of weight from one foot to the other and the downswing motion being executed with a shifting of weight back to the one foot, the training method comprising repeated performance by a trainee of at least one swing drill, the at least one swing drill including execution of the following steps:

a) gripping a swingable elongated training implement between the hands;

b) gripping a first body spacer object between the legs to steady the lower body during the swing drill;

c) gripping a second body spacer object between the arms to help position the training implement during the swing drill; and d) swinging the training implement in a backswing motion and an opposed downswing motion to simulate the required sports swing with a shifting of weight from one foot to the other and back to the one foot;

wherein each of steps b) and c) is executed, either separately or together, while executing step d).

2. A method according to claim 1 wherein the backswing motion positions the swingable training implement over one of the trainee's shoulders and wherein step d) includes a follow-through motion positioning the training implement over the trainee's other shoulder.

3. A method according to claim 2 wherein the first body spacer object is a large, pliable ball having a diameter between about 25 and about 55 cm., a weight under about 0.45 kg. and wherein the large ball is gripped between the trainee's thighs during a training swing.

4. A method according to claim 3 wherein the second body spacer object is a medium ball with a diameter between about 10 cm. and about 25 cm. and a weight between about 1 kg. and about 5 kg. and wherein said medium ball is gripped between the elbows.

5. A method according claim 4 wherein the training drill further comprises a step of holding a small spacer object under the trainee's armpit on the backswing side of the trainee's body.

6. A method according to claim 5 further comprising gripping a small ball with a diameter between about 5 and 20 cm. and a weight between about 0.4 and 5 kg. between the forearms.

7. A method according claim 6 comprising repeatedly executing the training drill in a reverse direction from follow-through to backswing.

8. A method according to claim 7 comprising repeated execution of an ancillary drill additional to the drill defined in claim 10 wherein a small ball gripped between the hands is substituted for the swingable training implement during the swing motions.

9. A method according to claim 8 wherein the training swing is additionally executed repeatedly while in a seated position with a small ball gripped between the hands and with one or more of a large ball gripped between the thighs, a medium ball gripped between the elbows, a small ball gripped between the forearms and a small ball gripped under the armpit.

10. A method according to claim 2 wherein the second body spacer object is a medium ball with a diameter between about 10 cm. and about 25 cm. and a weight between about 1 kg. and about 5 kg. and wherein said medium ball is gripped between the elbows.

11. A method according claim 2 wherein the training drill further comprises a step of holding a small spacer object under the trainee's armpit on the backswing side of the trainee's body.

12. A method according to claim 2 further comprising gripping a small ball with a diameter between about 5 and 20 cm. and a weight between about 0.4 and 5 kg. between the forearms.

13. A method according claim 2 comprising repeatedly executing the training drill in a reverse direction from follow-through to backswing.

14. A method according to claim 2 comprising repeated execution of an ancillary drill additional to the drill defined in claim 2 wherein a small ball gripped between the hands is substituted for the swingable training implement during the swing motions.

15. A method according to claim 2 wherein the training swing is additionally executed repeatedly while in a seated position with a small ball gripped between the hands and with one or more of a large ball gripped between the thighs, a medium ball gripped between the elbows, a small ball gripped between the forearms and a small ball gripped under the armpit.

16. A method according to claim 2 wherein a rotational drill is additionally executed repeatedly while in a prone position with a small ball gripped between the hands and with one or more of a medium ball gripped between the knees, a medium ball gripped between the elbows, a small ball gripped between the forearms and a small ball gripped under the armpit, the small ball being swung from one side of the trainee's body to the other and the knees are rotated in an opposite direction.

17. A method according to claim 2 wherein the trainee is tethered by an elasticated tension belt secured to a mid-body portion of the trainee and having a horizontal component of extent.

18. A method according claim 2 wherein the sport is golf.

19. A method according to claim 1 performed under supervision of an instructor at a sports clinic.

20. A method of swing training for a sport requiring swinging of an elongated sports implement gripped between a player's hands while standing upright, the sports implement being swung backwardly in a backswing motion and forwardly in an opposed downswing motion to project a projectable object in a forward direction with respect to the player, the backswing motion being executed with a shifting of weight from one foot to the other and the downswing motion being executed with a shifting of weight back to the one foot, the training method comprising repeated performance by a trainee of at least one swing drill, the at least one swing drill including execution of the following steps:

a) gripping a swingable elongated training implement between the hands;

b) gripping a first body spacer object between the legs to steady the lower body during the swing drill;

c) gripping a second body spacer object between the arms to help position the training implement during the swing drill;

d) swinging the training implement in a backswing motion and an opposed downswing motion to simulate the required sports swing with a shifting of weight from one foot to the other and back to the one foot; and e) holding a small spacer object under the trainee's armpit on the backswing side of the trainee's body;

wherein each of steps b) and c) is executed, either separately or together, while executing step d) thereby to increase the flexibility of the respective limbs and induce physiological changes in specific muscle groups that enhance the actual sports swing.

21. A method according to claim 20 wherein the backswing motion positions the swingable training implement over one of the trainee's shoulders and wherein step d) includes a follow-through motion positioning the training implement over the trainee's other shoulder.

22. A method according to claim 21 wherein the first body spacer object is a large, pliable ball having a diameter between about 25 and about 55 cm., a weight under about 0.45 kg., wherein the large ball is gripped between the trainee's thighs during a training swing, wherein the second body spacer object is a medium ball with a diameter between about 10 cm. and about 25 cm. and a weight between about 1 kg. and about 5 kg. and wherein said medium ball is gripped between the elbows.

23. A method according to claim 22 further comprising gripping a small ball with a diameter between about 5 and 20 cm. and a weight between about 0.4 and 5 kg. between the forearms.

24. A method according claim 23 comprising repeatedly executing the training drill in a reverse direction from follow-through to backswing.

25. A method according to claim 23 comprising repeated execution of an ancillary drill additional to the drill defined in claim 2 wherein a small ball gripped between the hands is substituted for the swingable training implement during the swing motions.

26. A method according to claim 23 wherein the training swing is additionally executed repeatedly while in a seated position with a small ball gripped between the hands and with one or more of a large ball gripped between the thighs, a medium ball gripped between the elbows, a small ball gripped between the forearms and a small ball gripped under the armpit.

27. A method of swing training for a sport requiring swinging of an elongated sports implement gripped between a player's hands while standing upright, the sports implement being swung backwardly in a backswing motion and forwardly in an opposed downswing motion to project a projectable object in a forward direction with respect to the player, the backswing motion being executed with a shifting of weight from one foot to the other and the downswing motion being executed with a shifting of weight back to the one foot, the training method comprising repeated performance by a trainee of at least one swing drill, the at least one swing drill including execution of the following steps:

a) gripping a swingable elongated training implement between the hands;

b) gripping a first and compressible spacing object between the thighs during the swing drill said first spacing having a gripped dimension between about 25 and about 55 cm.;

c) gripping a second and compressible spacing object between the elbows during the swing drill, said second spacing object having a gripped dimension between about 10 cm. and about 25 cm.; and d) swinging the training implement in a backswing motion and an opposed downswing motion to simulate the required sports swing with a shifting of weight from one foot to the other and back to the one foot;

wherein each of steps b) and c) is executed, either separately or together, while executing step d).

28. A method according to claim 27 wherein the backswing motion positions the swingable training implement over one of the trainee's shoulders and wherein step d) includes a follow-through motion positioning the training implement over the trainee's other shoulder.

29. A method according to claim 27 wherein the training drill further comprises a step of holding a spacer object under the trainee's armpit on the backswing side of the trainee's body.

30. A method according to claim 29 further comprising gripping a small ball with a diameter between about 5 and 20 cm. and a weight between about 0.4 and 5 kg. between the forearms.

31. A method according claim 29 wherein the sport is golf.

32. Training apparatus for training for a sport requiring swinging of an elongated sports implement gripped between a player's hands while standing upright, the sports implement being swung backwardly in a backswing motion and forwardly in an opposed downswing motion to project a projectable object in a forward direction with respect to the player, the backswing motion being executed with a shifting of weight from one foot to the other and the downswing motion being executed with a shifting of weight back to the one foot, the training method comprising repeated performance by a trainee of at least one swing drill, the at least one swing drill including execution of the following steps:

a) gripping a swingable elongated training implement between the hands;

b) gripping a first body spacer object between the legs to steady the lower body during the swing drill;

c) gripping a second body spacer object between the arms to help position the training implement during the swing drill; and d) swinging the training implement in a backswing motion and an opposed downswing motion to simulate the required sports swing with a shifting of weight from one foot to the other and back to the one foot;

wherein each of steps b) and c) is executed, either separately or together, while executing step d) which training apparatus comprises:

i) a first body spacer object grippable between the legs;

ii) a second body spacer object grippable between the elbows; and iii) instructional material regarding the training method.

33. Apparatus according to claim 32 comprising the first body spacer object is a large pliable ball having a diameter between about 50 to 55 cm and a weight under 0.5 kg.

34. Apparatus according to claim 33 wherein the second body spacer object is a medium ball with a diameter between about 10 to 25 cm with a weight between about 1 and about 5 kg.

35. Apparatus according to claim 34 comprising a further body spacer object being a small ball with a diameter between about 5 to 20 cm and a weight between about 0.2 and 4 kg and said instructional material instructs that the small ball be gripped under one of the user's armpits.

36. Apparatus according to claim 35 comprising a simulated swingable training implement.

* * * * *